US006389953B1

(12) United States Patent
Altman et al.

(10) Patent No.: US 6,389,953 B1
(45) Date of Patent: May 21, 2002

(54) HYDRAULIC LEVELING CONTROL SYSTEM FOR A LOADER TYPE VEHICLE

(75) Inventors: Eugene Altman, Morton Grove; Brian Andrew Frey, Freeport, both of IL (US)

(73) Assignee: Delta Power Company, Rockford, IL (US)

( * ) Notice: Subject to any disclaimer, the term of this patent is extended or adjusted under 35 U.S.C. 154(b) by 41 days.

(21) Appl. No.: 09/685,907

(22) Filed: Oct. 10, 2000

Related U.S. Application Data

(63) Continuation-in-part of application No. 09/159,661, filed on Sep. 24, 1998, now Pat. No. 6,308,612.

(51) Int. Cl.[7] ..... F15B 11/22
(52) U.S. Cl. ..... 91/515; 414/708
(58) Field of Search ..... 91/171, 515, 520; 414/700, 708

(56) References Cited

U.S. PATENT DOCUMENTS

| | | | |
|---|---|---|---|
| 3,563,137 A | 2/1971 | Graber | |
| 4,114,516 A | 9/1978 | Johnson | |
| 4,408,518 A | 10/1983 | Diel | |
| 4,465,089 A | 8/1984 | Inhofer | |
| 4,531,536 A | 7/1985 | Kosarzecki | |
| 4,561,342 A | 12/1985 | Calvert | |
| 4,683,802 A | 8/1987 | Prokop | |
| 4,709,618 A | 12/1987 | Zongker | |
| 4,723,478 A | 2/1988 | Diel | |
| 4,799,851 A | 1/1989 | Swanson | |
| 4,815,357 A | 3/1989 | Truehart | |
| 5,447,094 A | 9/1995 | Geyler, Jr. | |
| 5,669,282 A | 9/1997 | Tanino | |
| 5,797,310 A | 8/1998 | Casey | |
| 6,308,612 B1 * | 10/2001 | Emanie et al. | 91/515 |

OTHER PUBLICATIONS

Sun drawings "High Capacity Flow Divider/Combiner", pp. 7–15, submited Sep. 9, 1994 (Cited in parent application 09/685,907).

* cited by examiner

*Primary Examiner*—F. Daniel Lopez
(74) *Attorney, Agent, or Firm*—Vernon J. Pillote

(57) ABSTRACT

A hydraulic control system for controlling the orientation of a material handling unit on a lift boom. The control system includes a flow divider/combiner valve operative in a boom-raise, unit-leveling mode to pass a portion of the fluid displaced from the rod end of the boom cylinder to the base end of the unit cylinder, and operative in a boom-lower, unit-leveling mode, to combine the fluid stream displaced from the base end unit cylinder in a preset ratio with pressurized fluid, and pass the combined stream to the rod end of the boom cylinder. A modulating valve controls flow to and from the base end of the boom cylinder and is pilot actuated to inhibit descent of the boom until the pressure in the unit cylinder reaches a level at which the unit cylinder initiates levelling of the unit.

17 Claims, 6 Drawing Sheets

16
16b
16a
19
19b
19a
M
3
4
38
38b
45
7
8
58a
38a
58
58b
38d
38c
46
55
55a
56
56a
52
51
1
2
5
6
25f
25
25e
25d
35
36
26f
26c
50
25c
36a
35a
26d
26b
26
25a
R
26a
25b
16b
16
16a
19
19b
19a

M
3
4
7
8
38
38b
45
58a
38a
58
58b
38d
38c
46
55
55a
56
56a
52
51
1
2
5
6
25f
25
25d
35
36
26f
26c
50
25c
36a
35a
26d
26b
26
R
25a
R
26a
25b 16
16b
16a
19
19b
19a
M
3
4
7
8
38
38b
38a
38d
38c
45
46
58a
58
58b
55a
55
56
56a
52
51
1
2
5
6
25f
25e
25d
25
25c
25b
25a
35
36
36a
35a
26f
26c
50
26d
26
26a
26b
R 16
16b
16a
19
19b
19a
M
3
4
7
8
38
38b
38a
38d
38c
45
46
58
58b
55a
55
56
56a
52
51
1
2
5
6
25f
25e
25d
25c
25
25a
R
25b
35
36
36a
35a
26f
26c
50
26d
26b
26a
26

HYDRAULIC LEVELING CONTROL SYSTEM FOR A LOADER TYPE VEHICLE

CROSS REFERENCE TO RELATED APPLICATION

This application is a continuation-in-part of the Faraidoon F. Emanie and Brian A. Frey, Ser. No. 09/159,661, filed Sep. 24, 1998, now U.S. Pat. No. 6,308,612, for Hydraulic Leveling Control system for a Loader Type Vehicle.

BACKGROUND OF THE INVENTION

The present invention relates to a hydraulic control system for a loader type vehicle and particularly to an improved hydraulic system for raising and lowering the boom and controlling the attitude of a material handling unit supported on the:boom during raising and during lowering of the boom.

Loader type vehicles generally include a boom pivotally carried on the vehicle with a material handling unit pivoted on the free end of the boom. The boom is raised and lowered on the vehicle by a boom cylinder having fluid supplied thereto through a boom control valve and the material handling unit is pivoted on the end of the boom through a unit cylinder having fluid supplied thereto through a unit control valve. In the absence of any self-leveling function, it is necessary for the operator of the loader type vehicle to operate both the boom control valve and the unit control valve to maintain the material handling unit level while raising and lowering the boom. This operation is not only difficult but also requires close attention of the operator.

Hydraulic leveling systems have heretofore been made such as disclosed in U.S. Pat. No. 3,563,137, in which fluid exiting from the rod end of the boom cylinder during raising of the boom, is passed through a valve type flow divider that directs one portion of the inlet flow to the piston end of the unit cylinder while dumping a remaining portion of the inlet flow to drain, to level the unit during raising of the boom. This patent also disclosed an embodiment to which the boom control valve was modified to provide a boom-raise, unit-leveling position and a boom-lower, unit-leveling position, in addition to the customary boom-raise and boom lower positions. In that embodiment, the boom control valve was operative to pass fluid exiting from the piston end of the boom cylinder during lowering of the boom through a second flow divider valve arranged to direct one portion of the flow to the rod end of the unit cylinder and to dump the remaining portion to drain. Valve type flow dividers divide flow from an inlet into separate streams at two outlets in accordance with the pressure drop through two orifices and can operate reliably only when the pressure at the inlet is greater than the pressure at either outlet. During lowering of the boom, a portion of the fluid from the piston end of the boom cylinder is passed to the rod end of the bucket cylinder. The area of the piston end of the boom cylinder is usually very large as compared to the area of the rod end of the unit cylinder and, under some operating conditions, the pressure at the piston end of the boom cylinder is too low as compared to the pressure required at the rod end of the bucket cylinder, to reliably move the bucket when the latter is loaded.

U.S. Pat. No. 5,447,094 discloses a leveling circuit using a valve type flow divider for controlling leveling of the bucket during raising of the boom and a motor type flow divider for controlling leveling of the bucket during lowering of the boom. While this hydraulic leveling system operates during both raising and lowering of the boom, the motor type flow divider significantly increases the cost of the leveling system. Further, motor type flow dividers divide flow in a fixed ratio and are not adjustable to change the fixed ratio to accommodate different size boom and unit cylinders such as are used in different loader-type vehicles.

SUMMARY OF THE INVENTION

It is an object of the present invention to provide a hydraulic control system for controlling the orientation of the material handling unit on a boom, and which is operative in an automatic leveling mode to reliably control leveling of the unit during both raising and lowering of the boom.

It is another object of the invention to provide a hydraulic control system for controlling orientation of a material handling unit on a lift boom, and which can be configured for use in material handling vehicles that have boom and unit direction control valves connected in parallel or in series.

Another object of this invention is to provide a hydraulic control system in accordance with the foregoing object, and which is operative when lowering the boom to modulate flow from the boom cylinder in a manner to control the start and rate of boom descent to effect reliable leveling of the unit.

Another object of this invention is to provide a hydraulic control system for controlling the orientation of material handling unit supported on a boom in accordance with the foregoing object and which is adapted for use with boom control valves having a float position.

In the present invention, a hydraulic control system is provided for operating a boom cylinder to raise and lower a boom and for operating a unit cylinder to tilt the unit relative to the boom. The control system is operative in a self-leveling mode to control leveling of the material handling unit during both raising and lowering of the boom, using a proportional flow divider/combiner valve having a primary inlet and first and second secondary outlets. In the automatic leveling mode, when the boom control valve is moved to a boom-raise position, fluid from the boom control valve is supplied to a boom-raise chamber in the boom cylinder and fluid from a boom-lower chamber in the boom cylinder is passed to the primary inlet of the flow divider/combiner valve which divides the flow into a first stream that is passed to the tilt-down chamber of the unit cylinder and a second stream which is returned to the reservoir through the boom control valve, to level the unit during raising the boom. When the boom control valve is moved to a boom-lower position, fluid from the boom control valve is supplied to a tilt-up chamber in the unit cylinder and to the second secondary passage of the flow divider/combiner valve, and flow from a tilt-down cylinder is passed to the first secondary passage of the flow divider/combiner valve. The streams from the first and second secondary passages are combined in a preset ratio in the flow divider/combiner valve and supplied to the boom-lower chamber of the boom cylinder to level the unit during lowering of the boom.

It is desired to initiate leveling of the unit when the boom starts to move down to inhibit spilling of material from the unit. In a presently preferred embodiment, the control system includes a modulating valve that is pilot actuated between open and closed positions to control flow to and from the boom-raise chamber of the boom cylinder. A pilot network is provided to operate the modulating valve when the boom control valve is in the boom-raise position, to open and pass fluid to the boom-raise chamber, and to operate the modulating valve when the boom-control valve is moved to a boom-lower position, to modulate flow from the boom-raise chamber and inhibit descent of the boom until the fluid pressure in the tilt-up chamber in the unit cylinder is sufficient to level the unit while the boom is lowered. The pilot network is also operative when the boom control valve is moved to a float position, to pass fluid from the boom-raise chamber of the boom cylinder and allow the boom to float down.

DETAILED DESCRIPTION

Figure 1:
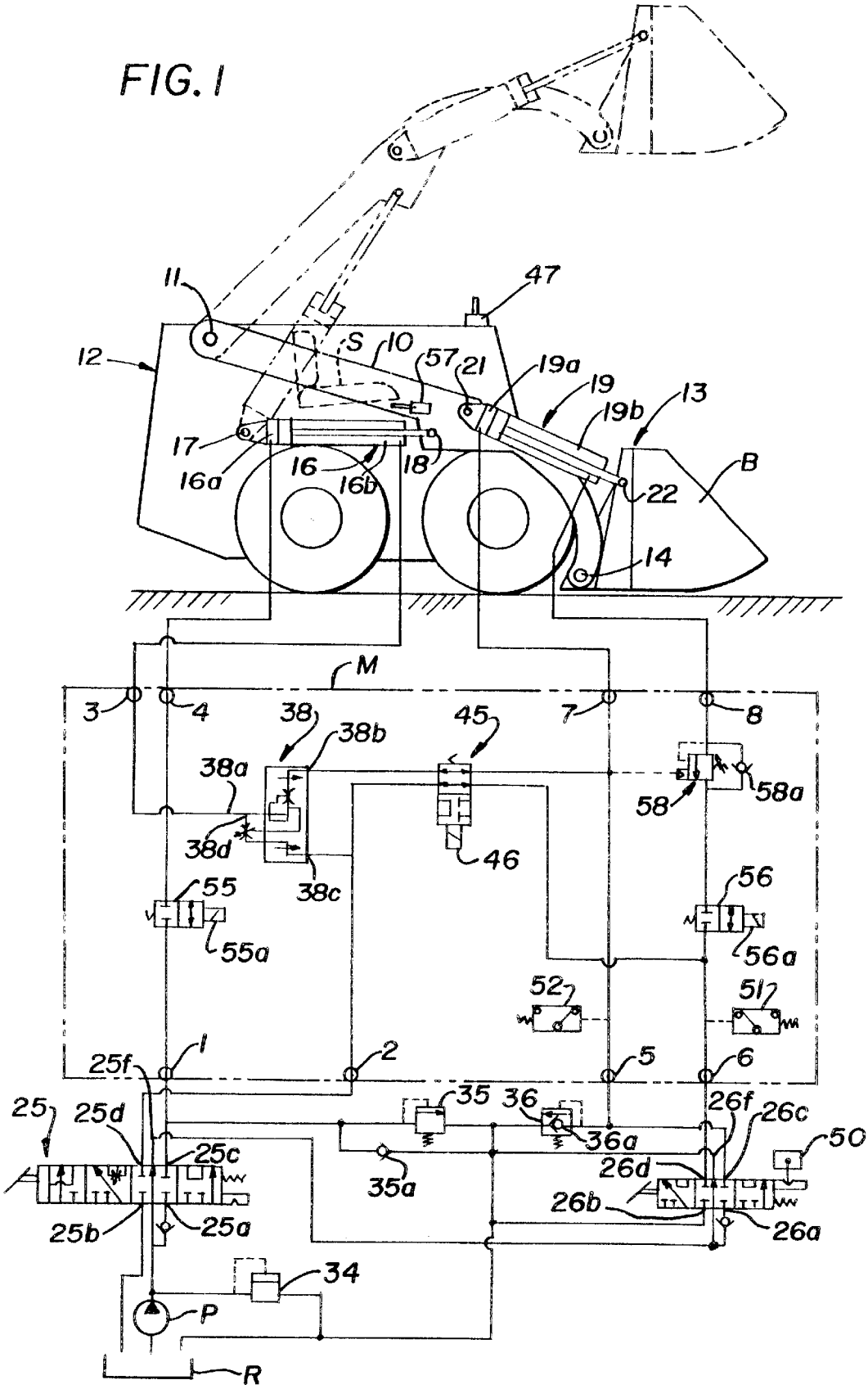
FIG. 1 is a schematic diagram illustrating one embodiment of a hydraulic control system for controlling a boom and a material handling unit supported on the boom, in a loader type vehicle, with the boom control valve and the unit valve shown in a neutral position.

The hydraulic control system of the present invention generally adapted for use on material handling equipment such as end loaders and fork lifts that have a boom 10 pivoted as indicated at 11 on a vehicle 12, and a material handling unit 13 pivoted as indicated at 14 on the free end of the boom. The material handling unit 13 may for example, include a bucket as shown at B in FIG. 1, or a fork as shown at F in the embodiment of FIG. 7. The boom is raised and lowered relative to the vehicle by one or more double acting cylinder and piston assemblies 16 having the base end pivoted at 17 to the vehicle and the rod end pivotally connected at 18 to the boom. The material handling unit 13 is tilted about the pivot 14 relative to the boom by one or more double acting cylinder and piston assemblies 19, with the cylinder end pivotally connected at 21 to the boom and the rod end pivotally connected as indicated at 22 to the, material handling unit 13. For convenience the term boom cylinder is hereinafter used to refer to one or more hydraulic cylinder and piston assemblies used to raise and lower the boom, and the term unit cylinder is used to refer to one or more cylinder and piston assemblies used to tilt the unit relative to the boom.

A boom control valve 25 is provided for reversibly supplying fluid under pressure to the boom cylinder 16, and a unit control valve 26 is provided for reversibly supplying fluid to the unit cylinder 19. The boom control valve 25 and unit control valve 26 can be connected in parallel or in series and open center series connected directional control valves are schematically illustrated in drawings. The boom control valve 25 has a fluid pressure inlet 25*a* and a fluid outlet 25*b*, a first control port 25*c* and a second control port 25*d*. The unit control valve 26 has a fluid pressure inlet 26*a* and a fluid outlet 26*b* and a first control port 26*c* and a second control port 26*d*. The control valves 25 and 26 schematically illustrated are of the open center type. In the neutral position of the valves shown in FIG. 1, in which the boom is neither being raised or lowered, fluid under pressure from a pump P is passed through a fluid outlet 25*f* in the boom control valve 25 to the unit control valve 26 and returned from the unit control valve through a fluid outlet 26*f* to a hydraulic fluid reservoir R.

Boom control valve 25 has a second or boom-raise position; a third or boom-lower position, and a fourth or float position. The unit control valve 26 is preferably of the three position type having a second or tilt-down position and a third or tilt-up position. In the embodiment illustrated, valves 25 and 26 are arranged to be manually operated by levers.

For reasons described more fully hereinafter, a first or primary pressure regulating valve 34 is connected to the outlet end of the pump P to control the pressure at a preselected system pressure. A second pressure regulating valve 35 is connected to the first control outlet 25*c* of the boom control valve 25, and a third pressure regulating valve 36 is connected to the control port 26*c* of the unit control valve.

The unit leveling circuit includes a proportional flow divider/combiner valve 38 having a primary passage 38*a* and a first secondary passage 38*b* and a second secondary passage 38*c*. Flow divider/combiner valves are configured for use alternately as a flow divider to divide a single inlet stream of hydraulic fluid entering the primary passage 38*a* in a preset ratio into two separate branch outlet streams that exit from the first and second secondary passages 38*b* and 38*c* at flow rates that are kept proportional to one another at various inlet flow rates and, reversely as a flow combiner, for keeping proportional to one another and combining, two separate inlet streams entering the first and second secondary passages 38*b* and 38*c* in said preset ratio into a single outlet stream exiting from the primary passage 38*a*. The ratio of flow dividing and combining is controlled by two orifices, each communicating with the primary passage and with a respective one of secondary passages. Flow dividers are commonly made with fixed orifices to provide a fixed ratio, for example 50/50 and a different ratio can be provided by making two fixed orifices of relatively different size. The flow divider/combiner valve is preferably configured so that the ratio of flow dividing and combining is adjustable from externally of the valve. This can be effected by providing an orifice between the primary passage and one of the secondary passages that is adjustable from externally of the valve housing. The externally adjustable orifice can be provided in lieu of one fixed orifice as indicated at 38*d* in FIG. 1, or by an externally adjustable orifice can be between the primary passage and a secondary passage, hydraulically parallel to one of the fixed orifices in the valve, as schematically indicated at 138*d* in FIG. 7.

When the boom control valve 25 is in its neutral position shown in FIG. 1, it blocks flow from the pressure supply passage 25*a* to the first control outlet 26*c* and also blocks return flow from the control outlet 25*d* to the fluid outlet 25*b*. Similarly, when the unit control valve is in its neutral position shown in FIGS. 1–3, it blocks flow from the pressure supply inlet 26*a* to the first control outlet 26*c* and also blocks return flow from the second control outlet 26*d* to the fluid outlet 26*b*.

Figures 2, 3:
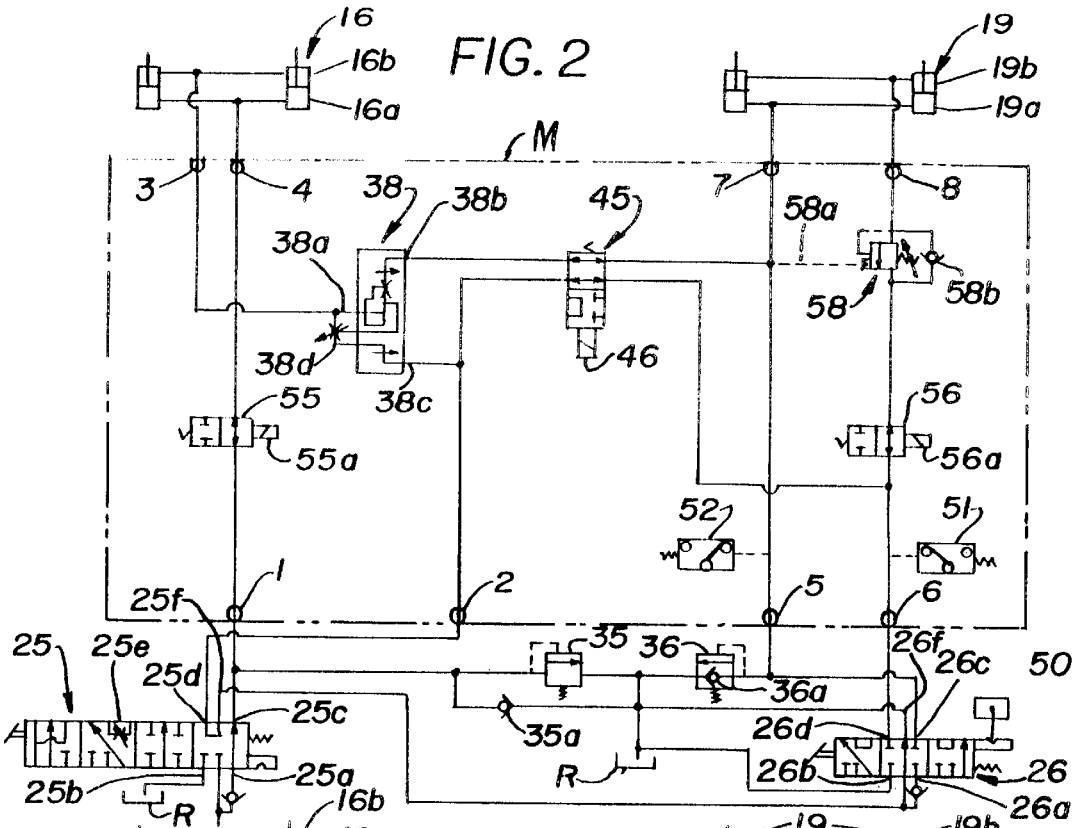
FIG. 2 is a schematic diagram of the hydraulic control system of FIG. 1 illustrating the system in a boom-raise, unit-leveling mode.
FIG. 3 is a schematic diagram of the control system of FIG. 1 illustrating the system in a boom-lower unit-leveling mode.

The control system is operable in a boom-raise, unit-leveling mode with the unit control valve 26 in its neutral position and the boom control valve 25 moved from the neutral position to a boom-raise position as schmetically shown in FIG. 2, to maintain the unit in a preset orientation with respect with a reference plane such as the ground, as the boom is raised. In the boom-raise, unit-leveling mode, the control system provides passage means for passing hydraulic fluid from the fluid pressure inlet 25*a* through the first control outlet 25*c* of the boom control valve 25 to the boom-raise chamber 16a of the boom cylinder 16, and for passing hydraulic fluid from the boom-lower chamber 16*b* to the primary passage 38*a* of the flow divider/combiner valve 38. The flow divider/combiner valve divides the inlet stream from the primary passage 38*a* into first and second outlet streams at the first and second secondary passages 38*b* and 38*c* respectively. In the boom-raise, unit leveling mode as shown in FIG. 2, the control system also provides passage mens for passing the first outlet stream exiting from the first secondary outlet passage 38*b* of the flow divider/combiner valve to the tilt-down chamber 19*a* in the unit cylinder 19, to tilt the unit downwardly as the boom is raised. As shown in FIG. 2, the control system also provides passage means for passing fluid from the tilt-up chamber 19*b* of the unit cylinder 19 and from the second secondary passage 38*c* of the flow divider/combiner valve, to the second control port 25*d* of the boom control valve for return to the reservoir R. Thus, a preset portion of the fluid displaced from the boom-lower chamber 16*b* of the boom cylinder during raising the boom, is passed from the flow divider/combiner valve to the tilt-down chamber 19*a* of the unit cylinder, to maintain the unit in a preset orientation relative to the ground during raising the boom.

The control system is also arranged for operation in a boom-lower, unit-leveling mode with the unit control valve in its neutral position, when the boom control valve is moved from the neutral position to a boom-lower position, shown in FIG. 3, to maintain the unit 13 in a preset orientation with respect to a reference plane such as the ground, as the boom is lowered. In the boom-lower, unit-leveling mode shown in FIG. 3, the control system forms a hydraulic circuit configured to provide passages for passing hydraulic fluid from the fluid pressure inlet 25*a* of the boom control valve 25 to the tilt-up chamber 19*b* of the unit cylinder 19 and to the second secondary passage 38*c* of the flow divider/combiner valve 38 and a passage for passing fluid from the tilt-down chamber 19*a* to the first secondary passage 38*b* of the flow divider/combiner valve 38. In the boom-lower, unit-leveling mode, the flow divider/combiner valve operates to combine the two separate inlet streams from secondary passages 38*b* and 38*c* in the preset ratio into a combined outlet stream at the primary passage 38*a*, and as shown in FIG. 3, the combined outlet stream from primary passage 38*a* is passed through a passage to the boom-lower chamber 16*b* of the boom cylinder 16, and fluid from the boom-raise chamber 16*a* is passed through a passage to the first control outlet 25*c* of the boom control valve and returned to the reservoir R.

Thus, in the boom-lower, unit-leveling mode, fluid pressure is supplied from the boom control valve 25 to the tilt-up chamber 19*b* of the unit cylinder and fluid displaced from the tilt-down chamber 19*a* of the unit cylinder is combined in a preset ratio with pressurized fluid in the flow divider/combiner valve and the combined stream passed to the boom-lower chamber 16*b* of the boom cylinder. Fluid from the boom-raise chamber 16*a* of the boom cylinder is returned through the boom control valve to the reservoir.

In order to assure that automatic leveling of the unit begins as soon as the boom starts to move down, fluid pressure should be generated in the tilt-up chamber of the unit cylinder sufficient to move the unit under the maximum load carried by the unit, before the boom starts to move down. The boom and the unit and load carried by the unit is supported by the fluid pressure in the boom-raise chamber of the boom cylinder and control system includes means arranged to supply fluid pressure to the tilt-up chamber of the unit cylinder prior to opening the boom-raise chamber 16*a* of the boom cylinder 16 to the reservoir.

The embodiment of FIGS. 1–6, the boom control valve is configured such that the control valve opens to supply fluid pressure to the tilt-up chamber of the tilt cylinder, before it opens to pass fluid from the boom-raise chamber of the boom cylinder to the reservoir, when the boom control valve is moved from the neutral to the boom-lower position. The boom control valve 25 is of the type having a meter-out spool system as schematically indicated at 25*e*, which is configured to provide a progressive change in the volume of flow from the first control port 25*c* to the reservoir, as the spool is moved from the neutral position to the boom-lower position.

Figure 4:
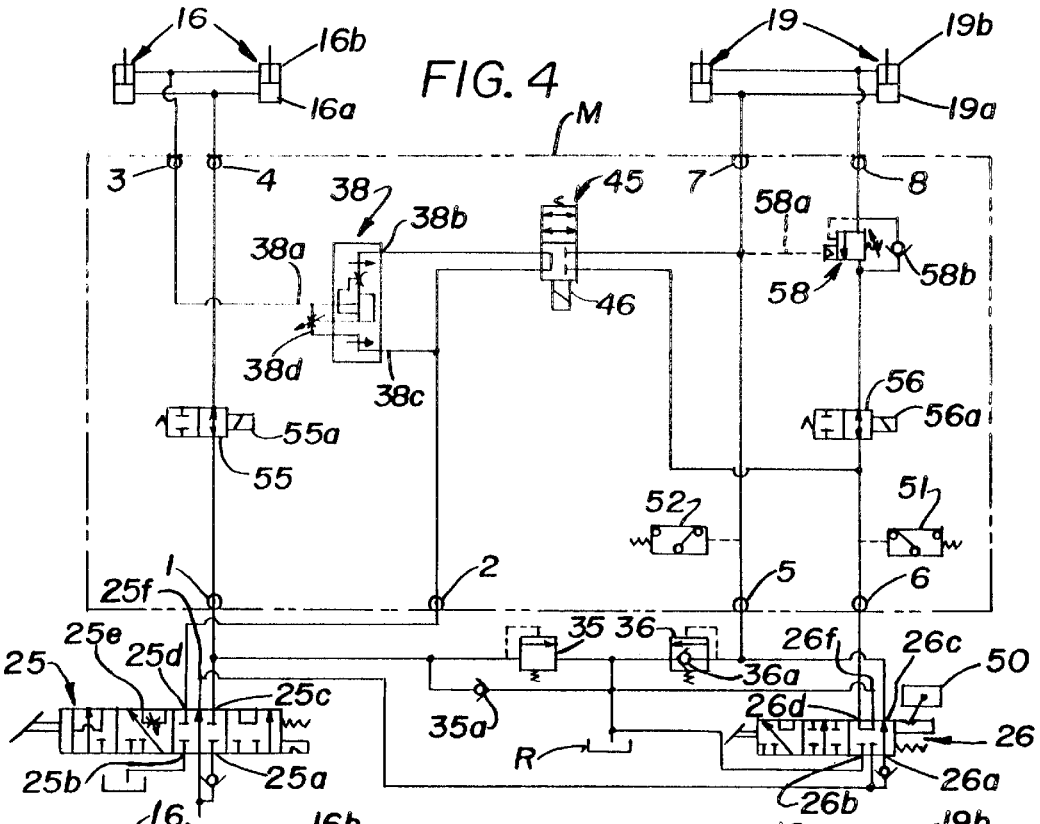
FIG. 4 is a schematic diagram of the control system of FIG. 1 illustrating the control system in a manual mode with the unit control valve in a position to tilt the unit downwardly.
Figure 5:
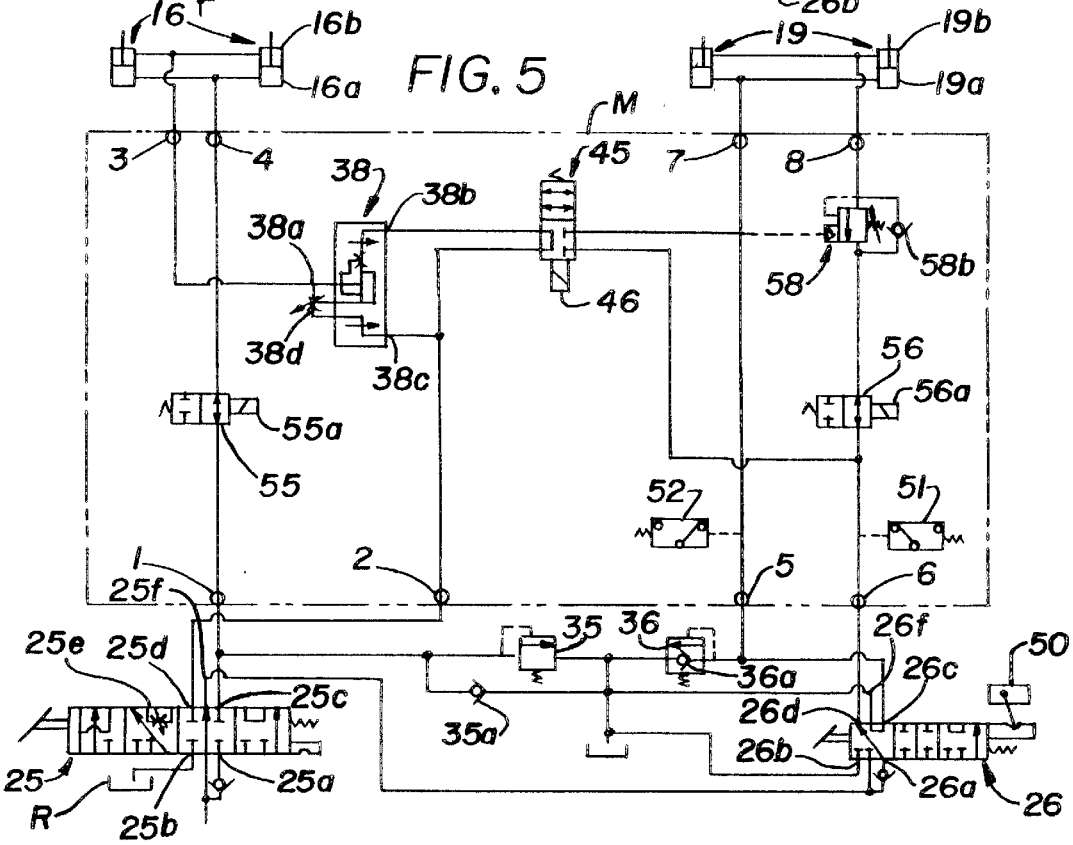
FIG. 5 is a schematic diagram of the control system of FIG. 1 in a manual mode with the unit control valve in a position to tilt the unit upwardly.
Figure 6:
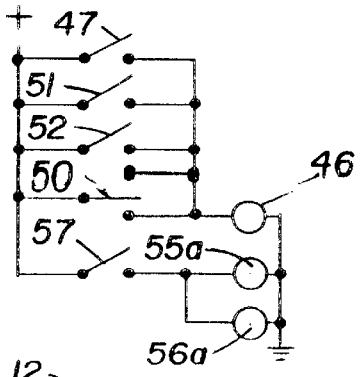
FIG. 6 is a schematic diagram of an electric circuit for actuating the electro-responsive valves used in the control system.

The control system includes valve means for disengaging the unit from the automatic leveling mode to enable raising and lowering of the boom and tilting of the unit downwardly and upwardly manually under the control of the boom control valve 25 and unit control valve 26. In the embodiment of FIGS. 1–6, the control system includes a four-way two-position disengagement valve 45 which is movable between an open position as shown in FIGS. 1–3, to a closed position as shown in FIGS. 4 and 5 in which it blocks flow from the tilt-down chamber 19*a* of the unit cylinder to the first secondary passage 38*b* of the flow divider/combiner valve; blocks flow from the tilt-up chamber 19*b* of the unit cylinder 19 to the second secondary passage of the flow divider/combiner valve, and communicates the first secondary passage with the second secondary passage of the flow divider/combiner valve. Valve 45 is moved by a spring to one position and by an actuator to the other position. The valve 45 shown herein is spring biased open and moved by a solenoid actuator 46 from its normally open position shown in FIGS. 1–3 to its closed position shown in FIGS. 4 and 5. A manually operable switch diagrammatically indicated at 47 in FIG. 1 and schematically illustrated in FIG. 6, is provided to enable selective operation of the valve 45 to its leveling disengagement position, for manual control of raising and lowering of the boom and tilting of the unit under the control of boom valve 25 and tilt valve 26. Provision is also made for automatic operation of valve 45 to its leveling disengagement position. A switch 50 is arranged for actuation by the unit control valve 26 to disengage automatic leveling when the unit control valve is moved from its neutral position to either its tile-up or tilt-down positions. As diagrammatically illustrated in FIGS. 1–5, a first pressure responsive switch 51 is arranged for actuation from a normally open to a closed position, when the pressure in the tilt-up chamber 19*b* of the unit tilt cylinder 19 exceeds a preset value substantially below system pressure, and a second pressure responsive switch 52 is provided and arranged for actuation to a closed position when the pressure in the tilt-down chamber 19*a* of the unit cylinder 19 exceeds a preset value substantially below system pressure, to disengage automatic leveling when the pressure reaches the preset value. Thus, the automatic leveling disengagement valve 45 is actuated to disengage automatic leveling in response to either manual operation of switch 47 or by closing the switch 50 in response to operation of the unit control valve 25 from its neutral position to either the tilt-up or the tilt-down positions, or by pressure responsive switches 51 and 52. Pressure switches 51 and 52 will also be actuated to disengage automatic leveling when the unit cylinder bottoms out at either end of the stroke. Accordingly, when the unit cylinder bottoms out, the boom cylinder can continue either raising or lowering the boom at the same speed as before the unit cylinder bottomed out. If the boom control valve is operated to continue movement of the boom cylinder after the unit cylinder bottoms out and until the boom cylinder reaches a bottom out position, then the boom and unit cylinders will bottom out at the same time in the next operation.

When the valve 45 is in the leveling disengagement position shown in FIGS. 4 and 5, the control system is operable in a manual mode to provide passages connecting the second control outlet 26*c* of the unit control valve 26 to the tilt-down chamber 19*a* and passages connecting the first control outlet 26*d* to the tilt-up chamber,19*b* of the unit cylinder 19, so that the unit cylinder can be operated to tilt the unit up or down. In the manual mode, the control system also provides passages connecting the first control outlet 25*c* of the boom control valve to the boom-raise chamber 16*a*, and passages that connects the second control outlet 25*d* to the second secondary passage 38*c* and through the valve 45 to the first secondary passage 38*b* of the flow divider/combiner valve 38; and passages that connects the primary passage of the flow divider/combiner valve 38 to the boom-lower chamber 18*b* of the boom cylinder. Thus, when the boom control valve is moved to the boom-raise position, pressurized fluid is passed from the first boom control port 25*c* to the boom-raise chamber 16*a*, and fluid from the boom-lower chamber 16*b* is passed through the flow divider/combiner valve 38 and valve 45 to the second control port 25*d* of the boom control valve for return to the reservoir. When the boom control valve is moved to the boom-lower position, pressurized fluid is passed from control outlet 25*d* through valve 45 and flow divider/combiner valve 38 to the boom-lower chamber 16*b*, and fluid from the boom-raise chamber 16*a* is passed to the first control outlet 25*c*, and returned to the reservoir, to allow the boom to move down.

The pressure relief valves 35 and 36 are provided to enable the boom and bucket to be operated under control of boom valve 25 and bucket valve 26, to press the bucket down into the ground with sufficient force to raise the wheels on the forward end of the vehicle off the ground. Pressure relief valve 36 is set to relieve when the pressure at the base end of the unit cylinder exceeds a preselected value several hundred psi above the setting of the main relief valve 34 and relief valve 35 is set to relieve when the pressure in the base end of the boom cylinder reaches a preset value several hundred psi lower than the setting of the main relief valve 34. Check valve 35*a* is arranged to open for flow from the reservoir to the boom-lower chamber 16*b* of the boom cylinder to prevent cavitation during lowering the boom under heavy load, and check valve 36*a* is arranged to open for flow from the reservoir to the tilt-down chamber 19*a* of the unit cylinder, to prevent cavitation during tilting the unit downwardly under heavy load.

Safety valves 55 and 56 are provided for preventing operation of the boom and unit cylinders, if an operator is not in proper operating position on the vehicle. Safety valve 55 is provided in the passage between the control outlet port 25*c* of the boom control valve and the boom-raise chamber 16*a* of the boom cylinder, and safety valve 56 is provided in the passage between the control outlet port 26*d* of the unit control valve and the tilt-up chamber 19*b* of the unit cylinder. These valves are of the two-position normally closed type and are operated by solenoids 55*a* and 56*a* respectively to an open position in response to closing of a safety switch 57 arranged to be actuated when the operator is in proper operating position on the vehicle. For example, as diagrammatically shown in FIG. 1, the switch 57 may be positioned to be actuated by the seat S of the vehicle, when the seat is occupied. As schematically illustrated in FIG. 6, switch 57 controls energization of solenoids 55*a* and 56*a* so that the valves 55 and 56 are actuated to their open positions whenever the vehicle operator is in proper position in the vehicle.

A counterbalance valve 58 is provided in the passage between the control port 26*d* of the unit control valve and the tilt-up chamber 19*b* of the unit cylinder 19, to restrict flow from the tilt-up chamber and prevent uncontrolled downward tilting of the unit by gravity. The counterbalance valve is pilot operated as indicated by pilot line 58*b* in response to pressure in the tilt-down chamber 19*a* of the unit cylinder, to release pressure in the tilt-up chamber at a preselected rate when the pressure in the tilt-down chamber reaches a preset value below system pressure. A check valve 58*a* is provided for bypassing the counterbalance valve to permit substantially unrestricted flow to the tilt-up chamber of the unit cylinder.

The flow divider valve 38, level disengaging valve 45, safety valves 55 and 56 and the counterbalance valve 58 are conveniently mounted in a manifold schmetically indicated by a broken line designated M. Pressure switches 51 and 52 are also conveniently mounted on the manifold at locations arranged to communicate with the appropriate passages in the manifold. The manifold has fittings 1 and 2 adapted for connection through hoses or lines to the boom valve 25 and fittings 3 and 4 adapted for connection through hoses or lines to the boom cylinder 16. Manifold also has fittings 5 and 6 adapted for connection through hoses or lines to the unit valve and fittings 7 and 8 adapted for connection through hoses and lines to the unit cylinder.

Figure 7:
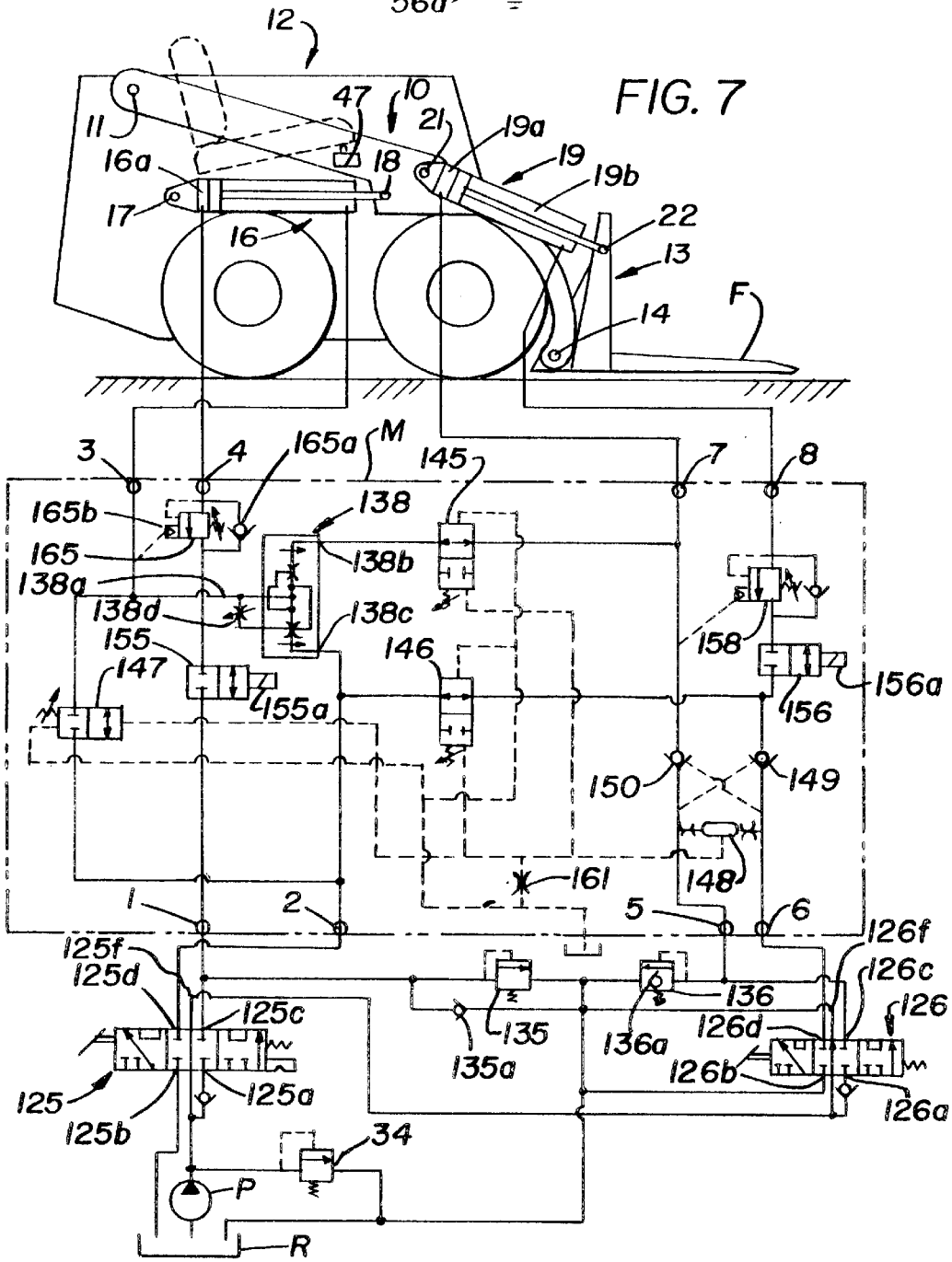
FIG. 7 is schematic diagram illustrating a second embodiment of a hydraulic control system for controlling leveling of the unit during raising and lowering of the boom.

A second embodiment of the invention is schmetically shown in FIG. 7 and like numerals are used to designate the same parts, and like numerals in the 100 series to designate corresponding parts of the control system. In the embodiment of FIGS. 1–6 the material handling unit 13 is illustrated as a bucket designated B. In the embodiment of FIG. 7 the material handling unit 13 is illustrated as a fork lift designated F. As described in the preceding embodiment, a boom control valve 125 is provided for reversibly supplying hydraulic fluid under pressure to the boom cylinder 16 and a unit control valve 126 is provided for supplying fluid under pressure to the unit cylinder 19. Valve 125 is a three-position valve having a fluid pressure inlet 125*a* and a return outlet 125*b*, a first control port 125*c* and a second control port 125*d* and a fluid outlet 123f. Unit tilt valve 126 is of the three-position valve type having a fluid pressure inlet 126*a*, return outlet 126*b*, and first and second control ports 126*c* and 126*d* respectively and a fluid outlet 126*f*. Fluid pressure from pump P is regulated by a primary pressure regulating valve 34 and is supplied to the fluid pressure inlet 125*a* and 126*a* of valves 125 and 126. The bucket leveling circuit includes a flow divider/combiner valve 138 having a primary passage 138*a* and a first secondary passage 138*b* and a second secondary passage 138*c*. The flow divider/combiner valve is configured to divide a single inlet stream entering the primary passage 138*a* in a preset ratio into two separate outlet streams exiting from the first and second secondary passages 138*b* and 138*c* and, reversely, to combine two separate inlet streams entering the first and second secondary passages 138*b* and 138*c* in said preset ratio into a single outlet stream exiting from the primary passage 138*a*. The flow divider/combiner valve 138 preferably has an adjustable orifice 138*d* connected between the primary passage 138*a* and one of the second secondary passages 138*c*, to enable adjustment of the preset flow divider/combiner ratio. When the boom control valve 125 is in its neutral position shown in FIG. 7, it blocks flow from the pressure supply passage to the first control port 125*c* and also blocks return flow from the control port 125*d* to the return passage 125*b*. Similarly, when the unit control valve is in its neutral position shown in FIG. 7, it blocks flow from the pressure supply inlet 126*a* to the first control port 126*c* and also blocks return flow from the second control port 126*d* to the return passage 126*b*.

The control system is operable in a boom-raise, unit-leveling mode with the unit control valve 126 in its neutral position and the boom control valve 125 in its boom-raise position, that is with the boom control valve shifted to the left as viewed in FIG. 7, to maintain the unit in a preset orientation with respect to a reference plane such as the ground, as the boom is raised. In the boom-raise, unit-leveling mode, the control system is configured to provide passages for passing hydraulic fluid from the fluid pressure inlet 125*a* to the boom-raise chamber 16*a* of the boom cylinder 16, and for passing hydraulic fluid from the boom-lower chamber 16*b* of the boom cylinder 16 to the primary passage 138*a* of the flow divider/combiner valve 138. The flow divider/combiner valve divides the inlet stream from the primary passage 138*a* into first and second secondary streams at passages 138*b* and 138*c* respectively. In the boom-raise, unit-leveling mode, the control system also provides passages for passing the outlet stream exiting from the first secondary outlet passage 138*b* of the flow divider/combiner valve to the tilt-down chamber 19*a* of the unit cylinder 19 and to pass the outlet stream from the second secondary passage 138*c* to the second control passage 125*d* of the boom control valve 125 for passage back to the reservoir R.

The control system is also arranged for operation in a boom-lower, unit-leveling mode, with the unit control valve 126 in the neutral position shown in FIG. 7, and with the boom control valve shifted to the right as viewed in FIG. 7, to a third or boom-lower position, to maintain the unit 13 in a preset orientation with respect to a reference plane such as the ground, as the boom is lowered. In the boom-lower, unit-leveling mode, the control system forms a hydraulic circuit configured to provide passage means for passing fluid from the fluid pressure inlet 125*a* of the boom control valve 125 to the second secondary passage 138*c* of the flow divider/combiner valve and to the tilt-up chamber 19*b* of the unit cylinder 19. In the boom-lower, unit-leveling mode, the hydraulic circuit also provides passage means for passing fluid from the tilt-down chamber 19*a* of the unit cylinder to the first secondary passage 138*b* of the flow divider/combiner valve 138 and the flow divider/combiner valve combines the two separate inlet streams from secondary passages 138*b* and 138*c* in the preset ratio into a single or combined outlet stream at the primary passage 138*a*. The combined outlet stream from the primary port of the flow divider/combiner valve 138 is passed through a passage to the boom-lower chamber 16*b* of the boom cylinder 16. Fluid from the boom-raise chamber 16*a* is returned to the reservoir R through the passage that communicates with the port 125*c* in the boom control valve.

As discussed in connection with the embodiment of FIGS. 1–6, to assure that automatic leveling of the unit brings when the boom starts to move down in the boom-lower, unit-leveling mode, fluid pressure should be generated in the tilt-up chamber 19*b* of the unit cylinder 19 sufficient to move the unit under the maximum load carried by the unit, before the boom starts to move down. In the embodiment of FIG. 7, the control system includes a load holding valve 165 which cooperates with the boom control valve 125, to assure supply of the fluid pressure to the tilt-up chamber of the unit cylinder, prior to opening of the boom-raise chamber of 16*a* of the boom cylinder to reservoir R. The load holding valve 165 is arranged in the passage between the boom-raise chamber 16*a* and the boom control valve 125 and is normally closed to hold the boom against downward movement and is pilot operated to an open condition to allow the boom to move down. A check valve 165*a* is arranged to by-pass the holding valve 165 and open for flow from the boom control valve to the boom-raise chamber 16*a*. A counterbalance valve is a type of load holding valve and the load holding valve symbol in FIG. 7 is that of a counterbalance valve. As is conventional, counterbalance valves are spring biased to a normally closed position to restrict flow and regulate pressure from the boom-raise chamber 16*a* and pilot operated to a flow condition. Valve 165 is conveniently pilot operated in response to fluid pressure conditions in boom-lower chamber 16*b*. In the boom-lower, unit-leveling mode, fluid pressure in the boom-lower chamber 16*b* builds up after the control valve is moved to its boom-lower position and fluid pressure is generated in the tilt-up chamber sufficient to move the load carrying unit and apply sufficient pilot pressure to operate load holding valve 165 to an open position.

The counterbalance valve 165 will restrict the flow rate from the boom-raise chamber of the boom cylinder, to the flow rate from the flow divider to the boom-lower chamber 16*b* during lowering the boom in either the self-leveling mode or the manual mode. For example if the rate of downward movement of the piston in the boom cylinder would exceed the inflow rate from the flow divider/combiner valve 138 during self-leveling mode, this would, cause a pressure reduction in the boom-lower chamber and this pressure reduction would reflect to the pilot of the counterbalance valve and reduce flow from the boom-raise chamber.

With the load holding valve 165 in control system to delay opening of the boom-raise chamber to drain, the boom control valve 125 can be a metering or not-metering type. As will be apparent to those skilled in the art, the load holding valve can be used in the embodiment of FIGS. 1–6, in the manner disclosed in FIG. 7.

The embodiment of FIG. 7 also includes means for disabling automatic leveling so that the control system can be operated in a manual mode. In the manual mode, the control system provides passages for connecting the boom control valve 125 to the boom cylinder 16 and the unit control valve 126 to the unit cylinder 19, to enable raising and lowering of the boom and tilting of the unit independently of each other under the control of boom control valve 125 and unit control valve 126. In this embodiment, a normally open two-way two-position valve 145 is arranged to be operated from a normally open position shown in FIG. 7 to a second position, to block flow between the tilt-down chamber 19*a* of the tilt cylinder and the first secondary passage 138*b* of the flow divider/combiner valve, and another two-way two-position valve 146 is arranged to be operated from a normally open position shown in FIG. 7 to a closed position blocking flow between the tilt-up chamber 19*b* of the tilt cylinder 19 and the second secondary passage 138*c* of the flow divider/combiner valve. A third two-way two-position valve 147 is arranged for-movement between a normally closed position as shown in FIG. 7 to an open position, to provide a by-pass passage between the second control port 25*d* of the boom control valve and the boom-lower chamber 16*b* of the boom cylinder 16.

Valves 145 and 146 are spring biased to a normally open position and pilot operated to a closed position, and valve 147 is spring biased to a normally closed position and pilot operated to an open position, when unit control valve 126 is moved from its neutral position to either a tilt-up or tilt-down position. The spring ends of these valves are vented by passages to the reservoir and as shown in FIG. 7, and pilot pressure to valves 145, 146, and 147 is provided from a back-to-back check valve 148 having inlets connected to control outlet ports 126*c* and 126*d* of unit control valve 126. The pilot passages are vented to reservoir through a flow restricter 161 to regulate pilot pressure. Pilot operated check valves 149 and 150 are provided to normally block flow through passages from tilt-up chamber 19*b* and from the tilt-down chamber 19*a* of the unit cylinder to the back-to-back check valve 148. When the unit control valve is moved to a tilt-down position, pressurized fluid is supplied from the pressure supply inlet 126*a* through the check valve 150 to the tilt-down chamber 19*a* and check valve 149 is pilot operated to an open position to allow flow from the tilt-up chamber 19*b* to the return outlet 126*b* of the unit control valve. When the unit control valve 126 is moved to the tilt-up position, fluid pressure is supplied from fluid pressure inlet 126*a* through check valve 149, to the tilt-up chamber 19, and check valve 150 is pilot operated open to pass fluid from the tilt-down chamber 19*b* to the return outlet 126*b*.

As described in connection with the embodiment of FIGS. 1–6, safety valves 155 and 156 are provided for preventing operation of the boom and tilt cylinders, if an operator is not in proper position in the vehicle. Safety valve 155 is in a passage between the control outlet port 125*c* of the boom control valve and the boom-raise chamber 16*a* of the boom cylinder, and safety valve 156 is in a passage between the control outlet port 126*d* of the unit valve and the chamber 19*b* of the unit cylinder. The valves are of the two-position, normally closed type and are operated by solenoids 155*a* and 156*a*, respectively to an open position in response to closing of a safety switch 47. As diagrammatically illustrated in FIG. 7, switch 47 is positioned to be actuated by the seat S of the vehicle when the seat is occupied. Thus, safety valves 155 and 156 are actuated to an open position whenever the vehicle operator is in proper position in the vehicle.

In the embodiment of FIG. 7, a counterbalance valve 158 is provided in the passage between the tilt-up chamber 19*b* of the unit cylinder and the control port 126*d* of the unit control valve for a purpose previously described in connection with the embodiments of FIGS. 1–6. Relief valves 135 and 136 and check valves 135*a* and 136*a* are connected to control ports 126*c* and 125*c* respectively for the purpose previously described in connection with the embodiments of FIGS. 1–6.

The flow divider/combiner valve 138, safety valves 145 and 146, by-pass valve 147, and emergency valve 158 are conveniently mounted in a manifold schematically indicated by broken out-line designated M. The manifold has fittings designated 1 and 2 adapted for connection through hoses to the boom valve 125 and fittings 3 and 4 adapted for connection through hoses to the boom cylinder 19. The manifold also has fittings 5 and 6 adapted for connection through hoses or lines to the unit valve 126 and fittings 7 and 8 adapted for connection through hoses or lines to the unit cylinder 19.

Figure 8:
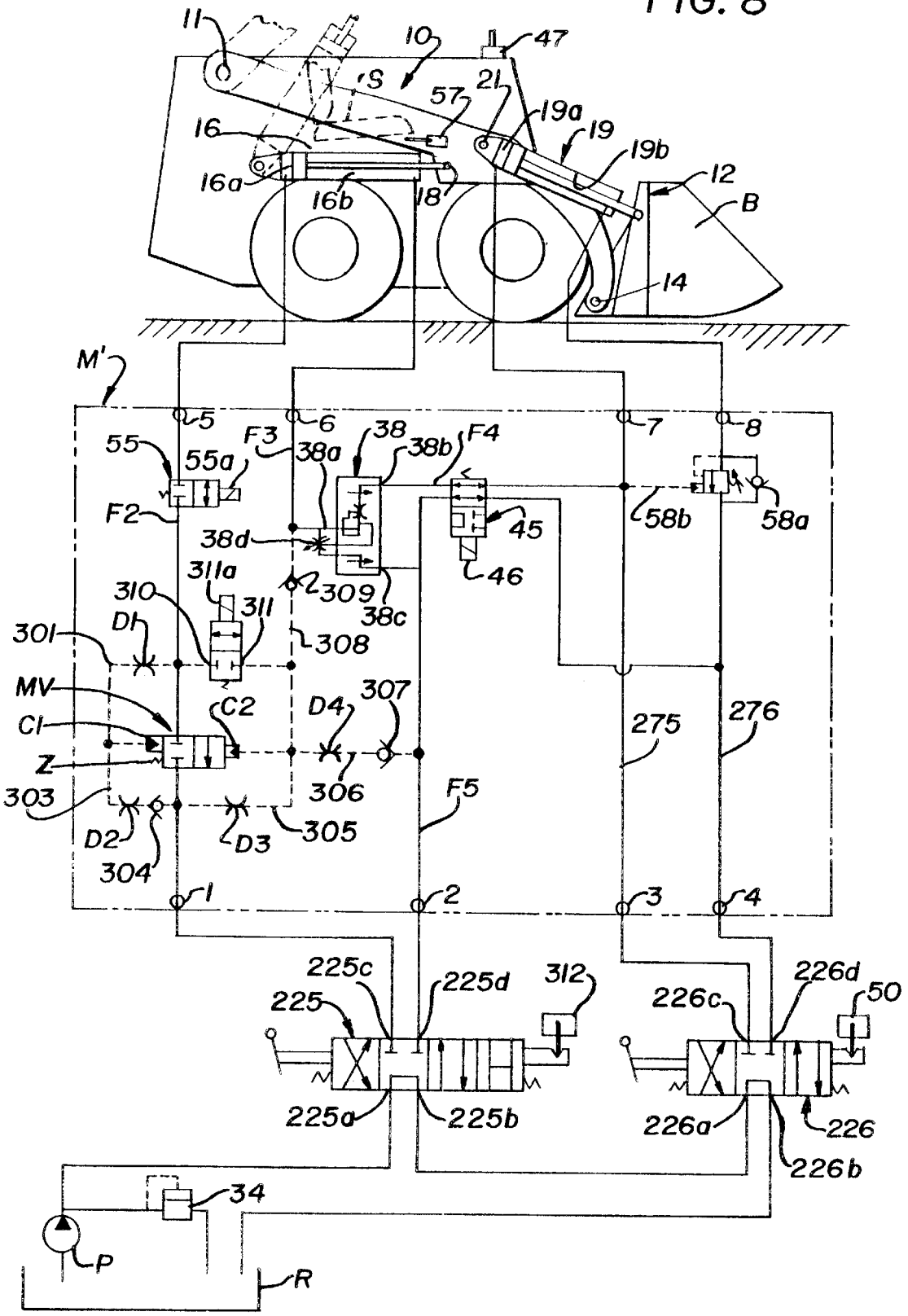
FIG. 8 is a schematic diagram illustrating a third embodiment of a hydraulic control system for controlling leveling of the unit during raising and lowering of the unit and float of the unit when the boom control valve is in a float position.
Figure 9:
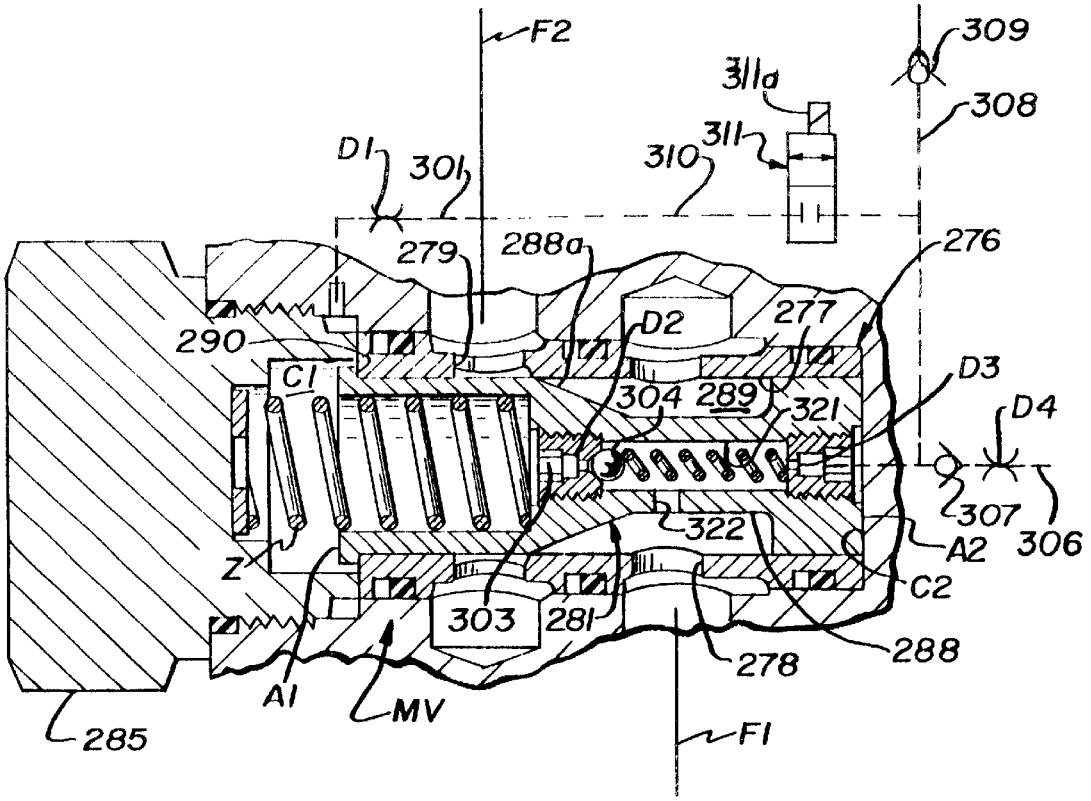
FIG. 9 is a longitudinal sectional view of a modulating valve for controlling flow to and from the boom-raise chamber of the boom cylinder.
Figure 10:
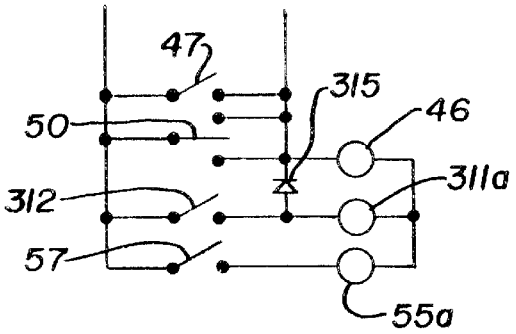
FIG. 10 is a schematic diagram of an electric circuit for actuating the electro-responsive valves in the control system of FIG. 8.

A third embodiment of the invention is schematically illustrated in FIGS. 8–10. This embodiment is similar to the embodiments in FIGS. 1–7 and provides an improved arrangement for controlling flow between the boom control valve and the boom-raise chamber of the boom cylinder and which is adapted for use in hydraulic systems having open and closed center boom control valves and unit control valves connected in parallel or in series and with boom control valves having a float position. In the embodiment of FIGS. 8–10, like numerals are used to designate the same parts as used in the embodiments of FIGS. 1–6, and numerals in the 200 and 300 series used to designate modified parts of the control system.

In the embodiment of FIGS. 8–10, a boom control valve 225 is provided for reversibly supplying hydraulic fluid under pressure to the boom cylinder 16 and a unit control valve 226 is provided for supplying fluid under pressure to the unit cylinder 19. Boom control valve 225 is a four-position directional control valve having a fluid pressure inlet 225*a* and a fluid outlet 225*b*, a first control port 225*c* and a second control port 225*d*, and is movable from a neutral position shown in FIG. 8, to a boom-raise position, a boom-lower position, and a float position. Unit directional control valve 226 is of a three-position directional control valve having a fluid pressure inlet 226*a*,. a fluid outlet 226*b* and first and second unit control ports 226*c* and 226*d* respectively, and is movable from a neutral position shown in FIG. 8, to a tilt-up position and a tilt-down position. Fluid pressure from a tank or reservoir R, pressurized by pump P and regulated by a primary pressure valve 34, is supplied to the fluid pressure inlets 225*a* and 226*a* of the valves 225 and 226. The boom control valve and unit control valve may be of the open center or closed center or tandem center type in which the control ports are blocked in the center or neutral positions and the valves can be connected in series of parallel.

The control system is preferably provided in a manifold M' having fittings 1 and 2 adapted for connection through hoses or lines to the control ports 225*c* and 225*d* of the boom control valves 225 and fittings 5 and 6 adapted for connection through hoses or lines to the boom cylinder 16. The manifold also has fittings 3 and 4 adapted for connection through hoses or lines to the control ports 226*c* and 226*d* of the unit control valve 226, and fittings 7 and 8 adapted for connection through hoses or lines to base end of 19*a* and rod end 19*b* of the unit cylinder 19.

The control system includes a flow divider/combiner valve 38 having a primary passage 38*a* and a first secondary passage 38*b* and a second secondary passage 38*c*. The flow divider/combiner valve is configured to divide a single inlet stream entering the primary passage 38*a* in a preset ratio into two separate outlet streams exiting from the first and second secondary passages 38*b* and 38*c* and, reversely, to combine two separate inlet streams entering the first and second secondary passages 38*b* and 38*c* in said preset ratio into a single outlet stream exiting from the-primary passage 38*a*. The flow divider-combiner valve 38 may have an adjustable orifice 38*d* connected between the primary passage 38*a* and the second secondary passage 38*c*, to enable adjustment of the preset flow divider/combiner ratio.

When the boom control valve 225 is in its neutral or center position shown in FIG. 8, it blocks flow to and from the first boom control port 225*c* and also blocks flow to and from the second boom control port 225*d*. Similarly when the unit control valve is in its neutral position shown in FIG. 8 it blocks flow to and from the first unit control port 226*c* and also blocks flow to and from the second unit control port 226*d*.

In the embodiment of FIGS. 8–10, a pilot actuated modulating valve MV is provided for controlling flow between the port 225*c* of the boom control valve and the boom-raise chamber 16*a* of the boom cylinder 16. As illustrated in FIG. 9, the modulating valve MV includes a valve housing 276 which may conveniently be mounted in the manifold M'. The valve housing has an elongated valve chamber 277, a first flow port 278 that communicates through a first flow passage F1 with the fitting 1 that is connected to the first boom control port 225*c*, and a second flow port 279 that communicates through a second flow passage F2 with the fitting 5 that is connected to the boom-raise chamber 16*a* at the base end of the boom cylinder. A valve spool 281 has first and second end portions slidable in the valve chamber, and the valve housing is configured to provide a first pilot chamber C1 at a first end area A1 of the valve spool and a second pilot chamber C2 at a second end area A2 of the valve spool. The valve spool has a reduced cross-section 288 intermediate the ends forming an annular flow space 289 in open communication with the first flow port 278. A spring Z is interposed between a cap 285 on the valve housing and the first end of the valve spool and applies a valve closing spring force that biases the valve spool toward the second pilot chamber C2 to a closed position. A stop such as a shoulder 290 on the valve spool engages the valve housing 277 in the closed position. The spring Z acting in the first end of the valve spool produces valve closing pressure Ps equal to the spring force divided by the pilot area A2 at the second end of the valve spool. The intermediate section 288 of the valve spool is preferably contoured as indicated at 288*a* to gradually increase the flow area between first and second flow ports as the valve is moved from its closed position toward its open position. The valve spool is preferably balanced with the net pilot area Al at the first end of the spool that is exposed to pressure in the first pilot chamber, the same as the net pilot area A2 at the second end of the spool that is exposed to pressure in the second pilot chamber.

As best shown in FIG. 8, a first pilot system is provided for applying pilot pressure proportional to the pressure differential between the second and first flow passages to the first pilot chamber C1 for urging the valve spool in the valve closing direction to a closed position. The first pilot system includes a first pilot passage 301 having a first pilot orifice C1 communicating the second flow passage F2 with the first pilot chamber C1, and a second pilot passage 303 having a second pilot orifice D2 communicating the first pilot chamber C1 with the first flow passage F1. The second pilot passage has a first pilot check valve 304 therein arranged to close and block the flow from the first flow passage F1 to the first pilot chamber C1. The first pilot system applies pilot pressure to the first pilot chamber C1 that is intermediate the pressure in the second flow passage and the pressure in the first flow passage, controlled by the ratio of size of the first pilot orifice C1 to the size of the second pilot orifice D2. Thus, the valve spool is pressed to a closed position by the spring pressure Ps applied by spring Z and by the pilot pressure Pc in the first pilot chamber C1.

A second pilot system is provided for applying pilot pressure to the second pilot chamber to actuate the valve spool of the modulating valve in a valve opening direction. The second pilot system includes means operative when the boom control valve supplies pressurized fluid to the fifth flow passage F5 in the boom-lower position, for applying pilot pressure to the second pilot chamber C2 to move the valve spool of the modulating valve out of the closed position when the pressure in the fifth flow passage actuates the unit cylinder to start tilt-up movement of the unit. As schematically shown in FIG. 8, a third pilot passage 305 having a third pilot orifice D3 communicates the second pilot chamber C2 with the first flow passage F1, and a fourth pilot passage 306 having a fourth pilot orifice D4 communicates the fifth flow passage F5 with the second pilot chamber C2 and through the third pilot passage 305 and orifice D3, with the first flow passage F1. The fourth pilot passage 306 has a check valve 307 therein arranged to block flow from the second pilot chamber to the fifth flow passage F5. The fourth and third pilot passages are operative, when the boom control valve is moved to the boom-lower position, to apply pilot pressure to the second pilot chamber C2 that is proportional to the pressure differential between the fifth flow passage F5 and the first flow passage F1. The pilot pressure applied to the second pilot chamber is controlled by the ratio of the size of orifice D4 to the size of the orifice D3 and the orifice sizes are advantageously selected so that the pilot pressure applied to the second pilot chamber C2 in the boom-lower position is sufficient to move the valve spool out of the closed position when the working pressure in the flow passage F5 reaches a preselected level high enough to actuate the unit cylinder to tilt-up the unit with a maximum load on the unit.

With this arrangement., the modulating valve remains closed in the boom-lower position until the working pressure in the fifth flow passage actuates the unit cylinder to initiate levelling of the unit under maximum rated load on the unit. When the load on the unit is less than maximum rated load, the unit cylinder will initiate tilt-up of the unit before the working pressure in the fifth flow passage reaches the preselected level, but opening of the modulating valve and lowering of the boom will be delayed until the working pressure does reach the preselected level.

The second pilot means also includes means operative in the boom-lower position when the pressurized fluid supplied to the unit cylinder initiates tilt-up movement of the unit and produces a positive pressure in the third flow passage F3, for opening the the modulating valve. As shown in FIG. 8, a fifth pilot passage 308 communicates the third flow passage F3 with second pilot chamber C2 and has a check valve 309 therein to block flow from the second pilot chamber to the third flow passage. Positive pressure is produced in the third flow passage when the unit cylinder is actuated to initiate leveling of the unit. The fifth pilot passage is operative in the boom-lower position to apply positive pressure from the third flow passage F3 to the second pilot chamber C2 to move the valve spool out of the closed position when the unit cylinder is actuated. Pilot pressure applied by the fifth pilot passage to the second pilot chamber will increase opening of the valve spool as the positive pressure increases and decreases opening of the valve spool as the positive pressure decreases. Accordingly, the speed at which the boom is lowered does not exceed the tilting speed of the unit. The positive pressure produced in the flow passage F3 when the unit cylinder is actuated to tilt the unit up, is substantially lower than the working pressure required in flow passage F5 to actuate he unit cylinder.

The second pilot system also includes a sixth pilot passage 310 having a normally closed pilot valve 311 communicating the second flow passage F2 with the second pilot chamber C2. Selectively operable means such as a solenoid 311*a* actuated by a switch 312 (FIG. 10), is provided for moving the pilot valve 311 to an open position and as shown in FIG. 8, the switch 312 is arranged to be operated by the boom control valve 225 when it is moved to the float position. The pilot valve is operative when open in the float position, to apply fluid pressure from the second flow passage F2 to the second pilot chamber C2 to move the modulating valve spool open and relieve pressure in the base end of the boom cylinder.

The several pilot passages and pilot orifices can be formed in the manifold M' as schematically illustrated in FIG. 8. For convenience in manufacture, some of the pilot passages and orifices can be provided in the valve spool. As shown in FIG. 9, the valve spool has a large axial passage 321 that has open communication through an opening 322 in the reduced intermediate portion 288 of the spool with the flow space 289 and the first flow port 278. The second pilot orifice D2 is formed in a plug mounted on the valve spool with the pilot orifice communicating at one end with the second pilot chamber C1 and at the other end through axial passage 321 and opening 322 and flow chamber 289 with the first flow port 278. The check valve 303 is formed by a check ball in the axial passage 321, biased by a spring to a closed position against the plug containing the second pilot orifice D2. The third pilot orifice D3 is formed in a plug mounted on the valve spool at the other end of axial passage 321, with the pilot orifice D3 communicating at one end with the second pilot chamber C2 and at the other end through the axial passage 321 and opening 322 and flow chamber 289 with the first flow control port 278.

When the loader is operated in the float position of the boom control valve, the unit is either unloaded or only lightly loaded and the pressure P2 induced in the flow passage F2 by the weight of the boom with an unloaded unit, is low as compared to the pressure induced in the flow passage F2 when operated in the boom-lower mode with a loaded unit. In order to open the modulating valve when the boom control valve is in the float position, the combination of the spring pressure Ps and the pilot pressure Pc applied to the first pilot chamber must be substantially less than the pressure P2 induced in the flow passage F2 by the weight of the boom with no load in the unit.

The amplitude of the pilot pressure Pc in the first pilot chamber C1 in relation to the pressure P1 in the first flow passage F1, is controlled by the ratio of the size of the first pilot orifice C1 to the size of the second pilot orifice D2, substantially in accord with the following equation for sharp edge orifices:

$$\frac{dD1}{dD2} = \left(\frac{Pc' - P1'}{P2' - Pc'}\right)^{\frac{1}{4}}$$

Where dD1 and dD2 are the diameters of orifices C1 and D2 respectively; the pressure: P2' is the pressure induced in flow passage F2 by the weight of the boom with an unloaded unit; Pc' is the pilot pressure, applied to the first pilot chamber C1 by the pressure P2' in flow passage F2, and P1' is the pressure in flow passage F1 in the float position.

BOOM-RAISE UNIT-LEVELING

The control system of FIGS. 8–10 is operable in a boom-raise unit-leveling mode with the unit control valve 226 in its neutral position and boom control valve 225 in its boom-raise position, that is with the boom control valve shifted to the left as viewed in FIG. 8, to level the unit as the boom is raised. In the boom-raise, unit-leveling mode, the boom control valve passes hydraulic fluid from the fluid pressure inlet 225*a* through the first control outlet 225*c* and the first flow passage F1 to the first flow port 278 in the modulating valve MV. Check valve 304"blocks flow through the second pilot passage 303 to the first pilot chamber C1. Check valve 307 blocks flow from the second pilot chamber C2 through the fourth pilot passage 306 to the fifth flow passage F5. Fluid pressure from the first flow passage F1 is applied through the third pilot passage 305 to second pilot chamber C2 to open the modulator valve MV and pass pressurized fluid from the first flow passage F1 through the second flow passage F2 to the boom-raise chamber 16*a* of the boom cylinder 16.

Fluid from the boom-Lower chamber 16*b* at the rod end of the boom cylinder 16 is passed through a third flow passage F3 to the primary passage 38*a* of the a flow divider/combiner valve 38. The flow divider/combiner valve divides the inlet stream from the primary passage 38*a* into first and second secondary flows at the first and second secondary passages 38*b* and 38*c* respectively. In the boom-raise, unit leveling mode, the secondary flow exiting from the first secondary passage 38*b* of the flow divider/combiner valve passes through a fourth flow passage F4 to the tilt-down chamber 19*a* of the unit cylinder 19 to control leveling of the unit 13 as the boom is raised. Fluid from the tilt-up chamber 19*b* of the unit cylinder and from the second secondary passage 38*c* of the flow divider/combiner valve is returned through the fifth flow passage F5 to the second boom control port 225*d* for return to the reservoir R.

BOOM-LOWER UNIT-LEVELING

When the boom control valve is moved to the neutral position while the boom is the raised position, the boom control valve blocks flow from the first flow passage F1 and holds the boom in the raised position. The valve spool in the modulating valve MV is also closed and blocks flow from the boom-raise chamber. When the boom control valve is moved from the neutral position to the boom-lower position, pressurized fluid is supplied from the second boom control port 225*d* to the fifth flow passage F5 and fluid from the first flow passage F1 is passed to the first boom control port 225*c* for return to the reservoir. The modulating valve MV and the pilot network for actuating the modulating valve are arranged to maintain the modulating valve closed to block flow from the boom-raise chamber until the pressure in the unit cylinder rises to a level sufficient to initiate leveling of the unit, before the modulating valve starts to open and allow the boom to move down. The boom load induced pressure in the second flow passage F2, is applied through the first-pilot passage 301 and the first pilot orifice C1 to the first pilot chamber C1 and through the second, pilot passage 302 and to the second pilot orifice D2 to the first flow passage F1. The pressure P2" induced in the second. flow passage F2 by the boom with the unit loaded, is higher than the pressure P2' induced by the boom with an unloaded unit as previously described. The pilot pressure Pc" applied to the first pilot chamber C1 by the load induced pressure P2" is proportional to the differential between the pressure P2" in the second flow passage F2,and the pressure P1 in the first flow passage F1, and the combination of the spring pressure Ps and pilot pressure Pc" urges the valve spool toward a closed position in the boom-lower position.

Fluid under pressure in the fifth flow passage F5 is applied through the fourth pilot passage 306 and pilot orifice D4 to the second pilot chamber C2 and through the pilot passage 305 and pilot orifice D3 to the first flow passage F1 and applies pilot pressure Po to the second pilot chamber C2 to urge the modulating valve open. The pilot pressure Po in the second pilot chamber C2 is controlled by the ratio of the size of the fourth pilot orifice D4 to the size of the third pilot orifice D3, substantially in accord with the following equation for sharp edge orifices:

$$\frac{dD4}{dD3} = \left(\frac{P5'' - Po''}{P0'' - P1''}\right)^{\frac{1}{4}}$$

Where dD4 and dD3 are the diameters of the orifices D4 and D3 respectively, the pressure P5" is the working pressure in the fifth flow passage F5 at which the unit cylinder initiates leveling of the unit cylinder under maximum rated load; P1" is pressure in the first flow passage F1 in the boom-lower position, and Po" is the pilot pressure which must be applied to the second pilot chambert C2 to open the modulating valve in the boom-lower position.

As previously described the spring Z induces a valve closing pressure Ps in the second pilot chamber C2 equal to the spring force divided by the second end area A2 of the valve spool. In order to open the modulating valve, the pilot pressure in the second pilot chamber C2, must be at pressure Po" sufficient to overcome the spring closing pressure Ps and the valve closing pressure Pc" in the first pilot chamber C1. Thus, Po" must be greater than the spring induced pressure Ps and the valve closing pilot pressure Pc" in the first pilot chamber, when the boom control valve is in the boom-lower position. The modulating valve and pilot networks are configured to delay downward movement of the boom in the boom lower position, until the pressure in the unit cylinder is sufficient to initiate leveling action under maximum rated load on the unit. The size of the orifices D3 and D4 is selected so that the pilot pressure Po" applied to the second pilot chamber C2 and acting on the second end of the valve spool in the boom-lower position, is insufficient to overcome the spring pressure Ps and the pilot pressure Pc", until the pressure in the fifth flow passage rises to a level P5" at which the unit cylinder initiates tilt-up movement of the unit under a maximum rated load on the unit. The ratio of the pilot orifices D4 and D3 can be selected in relation to the pressure in fifth flow passage F5; the pressure induced. in the pilot chamber C1 by the boom with the maximum rated load on the unit; the spring induced pressure Ps in the second pilot chamber C2; and the pressure P1 in the first flow passage F1, substantially in accord with the following equation for sharp edge orifices:

$$\frac{dD4}{dD3} = \left(\frac{Pc'' + Ps - P1''}{P5'' - Pc'' - Ps}\right)^{\frac{1}{4}}$$

where dD4 is the diameter of pilot orifice D4; dD3 is the diameter of pilot orifice D3; Ps is the spring pressure, P5" is the working pressure in fifth flow passage F5 at which the unit cylinder initiates tilt-up movement of the unit under maximum rated load; Pc" is the pressure induced in the second flow passage by the boom-with the unit under maximum rated load, and P1" is the pressure in the first flow passage F1 when the boom is in the raised position and the boom control valve is moved from the neutral position to the boom-lower position. The ratio dD4:dD3 is configured so that the modulating valve will remain closed under the boom load-induced pressure P2" in flow passage F2, until the pressure in the fifth flow passage rises above the pressure P5" at which the unit cylinder initiates tilt-up movement of the unit under a maximum rated load on the unit. Accordingly, lowering of the boom will start after the pressure in the flow passage F5 rises to the pressure sufficient to start leveling of the unit under maximum rated load. The pressure required to actuate the unit cylinder to initiate tilting the unit is less when the load on the unit is less than the maximum rated load. However, the pressure applied to the second pilot chamber C2 from the flow passage F5 will not be sufficient to actuate the modulating valve until the pressure rises to pressure P5".

A positive pressure is produced in the third flow passage F3 when the unit cylinder is actuated to initiate tilting of the unit. A fifth pilot passage 308 is arranged to apply pressure from the third flow passage to the second pilot chamber C2, to move the valve spool away from the closed portion when the positive pressure in third flow passage F3 is sufficient to overcome the spring pressure Ps and the pilot pressure Pc" in the first pilot chamber C2. A check valve 309 is provided in the pilot passage 308 and arranged to block flow from the second pilot chamber-C2 to the third flow passage. The fifth pilot passage will increase opening of the valve spool when the positive pressure in flow passage F3 increases above the combination of Ps and Pc" and decrease opening of the valve spool as the positive pressure decreases so that the speed at which the boom is. lowered does not exceed the tilting speed of the unit. The fifth flow passage is operative to actuate the modulating valve in response to the positive pressure produced in flow passage F3 whenever the unit cylinder is actuated to tilt the unit. However, the pressure in the. third flow passage will not be sufficient to actuate the modulating valve if the unit cylinder is not actuated or if the unit cylinder reaches the end of its stroke and stops leveling before the boom is fully lowered. As described hereinafter, the fifth pilot passage will also actuate the modulating valve when the control system is in a manual control mode. Thus, the fifth pilot passage is advantageously used in combination ,with the fourth pilot passage for actuating the modulating valve to control lowering of the boom. It is deemed apparent that the fourth pilot passage can be used without the fifth pilot passage to actuate the modulating valve in the boom-lower position, in control systems for some loader type vehicles, and that the fifth pilot passage can be used without the fourth flow passage to actuate the modulating valve in the boom-lower position, in control systems for some loader type vehicles.

BOOM FLOAT.

As previously described, the pilot passage 310 is operative, when the boom control valve is in the float position and the pilot valve 311 opened, to actuate the modulating valve and relieve fluid pressure induced in the the boom-raise chamber by the weight of the boom and unit, to allow the boom to move down. The first and second pilot passages 301 and 302 apply pilot pressure Pc' that is a fraction of the pressure differential between the flow passage F2 and the flow passage F1 to the first pilot chamber C1 while the pressure at passage F2 is also applied through the pilot valve 311 to the second pilot chamber C2 to open the modulating valve and allow the boom to move down. In the float position of the boom control valve, the first and fifth flow passages F1 and F5 are communicated with each other and with the reservoir, and the positive pressure produced in flow passage F3 from the boom-lower chamber when the boom floats up, is relieved through the flow divider/combiner valve 38.

CONTROL

The control system includes valve means for disengaging the unit from the automatic leveling mode to enable raising and lowering of the boom and tilting of the unit downwardly and upwardly manually under the control of the boom control valve 225 and unit control valve 226. The control system includes a four-way two-position disengagement valve 45 which is movable between an open position as shown in FIG. 8 to a closed position. In the closed position, valve 45 blocks flow through the fourth flow passage F4 between the tilt-down chamber 19*a* of the unit cylinder and the first secondary passage 38*b* of the flow divider/combiner valve; blocks flow through the fifth flow passage F5 between the tilt-up chamber 19*b* of the unit cylinder 19 and the second secondary passage 38*c* of the flow divider/combiner valve; and communicates the first secondary passage 38*b* with the'second secondary passage 38*c* of the flow divider/combiner valve. The valve 45 is spring biased open and moved by a solenoid actuator 46 from its normally open position shown in FIG. 8, to its closed position. A manually operable switch 47 is provided to enable selective operation of the valve 45 to its leveling disengagement position. Provision is also made for automatic operation of valve 45 to its leveling disengagement position. A switch 50 is arranged for actuation by the unit control valve 226 to disengage automatic leveling when the unit control valve is moved from its neutral position to either its tilt-up or tilt-down positions. The switch 312 for actuating the solenoid 311a of, the pilot valve 311 is also connected through a diode 315 to the solenoid 46, to actuate the leveling disengagement valve 45 to its closed position when the pilot valve 311 is actuated to the open position. A safety valve 55 having an actuator 55*a* is provided to prevent operation of the boom cylinder, if an operator is not in proper operating position on the vehicle. This valve is normally closed and actuated to an open position as by a safety-switch such as a seat switch 57 (FIG. 8).

When the valve 45 is in the leveling disengagement position, the control system is configured in a manual mode to provide a flow passage 275 connecting the control outlet 226*c* of the unit control valve 226 to the tilt-down chamber 19*a* and a flow passage 276 connecting the control outlet 226*d* to the tilt-up chamber of the unit cylinder 19. Thus, the boom cylinder can be manually-operated by the boom control valve 225 and the unit cylinder can be manually operated by the unit control valve 226 independent of the boom control valve 225.

The modulating valve MV and pilot network is also operative in the manual mode when the boom control valve is moved to the boom-raise position supplying pressurized fluid to flow passage F1, to open the modulator valve and pass fluid from flow passage F1 through flow passage F2 to the boom-raise chamber 16*a*, in the same :manner as described in connection with operation in the boom-raise, unit-leveling mode. Fluid from the boom-lower chamber is passed through flow passage F3 to the primary passage 38*a* of the flow divider/combiner valve 38, and from the secondary passages 38*b* and 38*c* of the flow divider/combiner valve 38 and through valve 45 and flow passage F5 to the second boom control port 225*d* of the boom control valve.

When the boom control valve is moved to the boom-lower position,- pressurized fluid is passed through the fifth-flow passage F5 and levelling disengagement valve 45 to both the first and second secondary passages 38*b* and 38*c* of-the flow divider/combiner valve 38 and from the primary passage 38*a* and flow passage F3 to the boom-lower chamber of the boom cylinder. The pilot passage 308 is. operative to apply pilot pressure from flow passage F3 to the pilot chamber C2 to open the modulating valve and pass fluid from the boom-raise chamber to the first control outlet 225*c* of the boom control valve, at a lower pressure in flow passage F5 than that required for operation on the boom-lower unit-leveling mode.

While preferred embodiments of the invention have been described in specific detail for purposes of illustration, it will be understood that various modifications may be made in the described embodiments without departing from the spirit and scope of the invention as defined in the appended claims.

The embodiments of the invention in which an exclusive property or priviledge is claimed are defined as follows:

1. A hydraulic control system for raising and lowering a lift boom pivotable with respect to a frame by a boom cylinder and for leveling a material handling unit pivotable with respect to the boom by a unit cylinder during raising and lowering the boom, the boom cylinder having a boom-raise chamber and a boom-lower chamber, the unit cylinder having a tilt-up chamber and a tilt-down chamber, the control system comprising:

(a) a directional boom control valve having first and second boom control ports, the boom control valve being selectively movable from a neutral position to a boom-raise, position passing fluid from a pressure source to the first boom control port and returning fluid from the second boom control port to a reservoir, and to a boom-lower position passing fluid from the pressure source to the second boom control port and returning fluid from the first boom control port to the reservoir, and to a float position communicating the first and second boom control ports with the reservoir;

(b) a directional unit control valve having first and second unit control ports, the unit control valve being selectively movable from neutral position to tilt-up position passing fluid from the pressure source to the first unit control port and to a tilt-down position passing fluid from the pressure source to the second unit control port;

(c) a modulating valve including valve housing means having an elongated valve chamber, a first flow port communicating through a first flow passage with the first boom control port and a second flow port communicating through a second flow passage with the boom-raise chamber of the boom cylinder, a valve spool slidable in the valve chamber between open and closed positions, the valve spool having first and second end areas cooperating with the valve housing means to define first and second pilot chambers at the first and second end areas respectively;

(d) a proportional flow divider/combiner valve having a primary passage and first and second secondary passages, the primary passage being connected by a third flow passage to the boom-lower chamber of the boom cylinder, the first secondary passage being connected by a fourth flow passage to the tilt-down chamber of the unit cylinder, and a fifth flow passage connecting the tilt-up chamber of the unit cylinder and the second secondary passage to the second boom control port, the flow divider/combiner valve being configured to divide a single inlet stream from the primary passage in a preset ratio into two separate outlet streams at the first and second secondary passages to control leveling of the unit when the boom control valve is moved to the boom-raise position, and reversely, to combine two separate inlet streams from the first and second secondary passages in said preset ratio into a single outlet stream at the primary passage, to control leveling of the unit when the boom control valve is moved to the boom-lower position;

(e) means pressing the valve spool of the modulating valve to a closed position-including a spring applying spring pressure to the valve spool and pilot means for applying pilot pressure from the second flow passage to the first pilot chamber, the spring and pilot means being configured so that the combined spring pressure and pilot pressure is less than the boom induced pressure in the second flow passage when the boom control valve is in the float position;

(f) means for actuating the valve spool of the modulating valve in the boom-raise, boom-lower and float positions of the boom control valve comprising:

(i) means operative in the boom-raise position for applying pilot pressure from the first flow passage to the second pilot chamber to move the valve spool away from the closed position;

(ii) means operative in the boom-lower position for applying pilot pressure to the second pilot chamber to move the valve spool away from the closed position when the unit cylinder initiates tilt-up movement of the unit and;

(iii) means including a pilot valve operative in the float position of the boom control valve for applying pilot pressure from the second flow passage to the second pilot chamber to move the valve spool away from the closed position.

2. A hydraulic control system according to claim 1 wherein said pilot means for applying pilot pressure to said first pilot chamber includes a first pilot passage having a first pilot orifice communicating the first pilot chamber with the second flow passage and a second pilot passage having a second pilot orifice communicating first pilot chamber with the first flow passage, the second pilot passage having a check valve therein arranged to block flow from the first flow passage to the first pilot chamber.

3. A hydraulic control system according to claim 1 wherein the means operative in the boom-lower position for applying pilot pressure to the second pilot chamber includes pilot passage means having a pilot orifice therein communicating the fifth flow passage with the second pilot chamber, the pilot passage means having a check valve therein to block flow from the second pilot chamber to the fifth flow passage.

4. A hydraulic control system according to claim 1 wherein the means operative in the boom-lower position for applying pilot pressure to the second pilot chamber includes pilot passage means communicating the third flow passage with the second pilot chamber and having a check valve therein for blocking flow from the second pilot chamber to the third flow passage.

5. A hydraulic control system according to claim 3 wherein the means operative in the boom-lower position for applying pilot pressure to the second pilot chamber includes pilot passage means communicating the third flow passage with the second pilot chamber and having a check valve therein to block flow from the second pilot chamber to the third flow passage.

6. A hydraulic control system according to claim 1 wherein said means pressing the valve spool to the closed position includes a first pilot passage having a first pilot orifice communicating the first pilot chamber with the second flow passage and a second pilot passage having a second pilot orifice communicating the first pilot chamber with the first flow passage, the second pilot passage having a check valve therein arranged to block flow from the first flow passage to the first pilot chamber, said means operative in the boom-raise position for applying pilot pressure to the second pilot chamber including a third pilot passage having a third pilot orifice communicating the first flow passage with the second pilot chamber.

7. A hydraulic control system according to claim 6 wherein the means operative in the boom-lower position for applying pilot pressure to the second pilot chamber includes a fourth pilot passage having a fourth pilot orifice communicating the fifth flow passage with the second pilot chamber, the fourth pilot passage having a check valve therein arranged to block flow from the second pilot chamber to the fifth flow passage, said third and fourth pilot orifices being configured to apply pilot pressure to the second pilot chamber to move the valve spool out of the closed position when the pressure in the fifth flow passage rises to a level at which the tilt-up cylinder initiates tilt-up movement of the unit.

8. A hydraulic control system according to claim 7 wherein the means operative in the boom-lower position for applying pilot pressure to the second pilot chamber includes a fifth pilot passage communicating the third flow passage with the second pilot chamber, the fifth pilot passage having a check valve therein arranged to block flow from the second pilot chamber to the third flow passage.

9. A hydraulic control system according to claim 6 wherein said means operative in the boom-lower position for applying pilot pressure to said second pilot chamber includes a pilot passage communicating the third flow passage with the second pilot chamber, said last mentioned pilot passage having a check valve therein arranged to block flow from the second pilot chamber to the third flow passage.

10. A hydraulic control system according to claim 1 including:

(a) a leveling disengagement valve means movable between open and closed positions, and means for moving the disengagement valve means between the open and closed positions, the leveling disengagement valve means being operative in the closed position:

(i) to block flow between the tilt-down chamber of the unit cylinder and the first secondary passage of the flow divider/combiner valve and:;

(ii) to block flow between the tilt-up chamber of the unit cylinder and the second secondary passage of the flow divider/combiner valve and;

(iii) to communicate the first secondary passage with the second secondary passage of the flow divider/combiner valve;

(b) the control system providing passage means operative when the leveling disengagement valve means is in the closed position, for passing fluid between the first unit control port and the tilt-down chamber of the unit cylinder and passage means for passing fluid between the second unit control port and the tilt-up chamber of the unit cylinder.

11. A hydraulic control system for raising and lowering a lift boom pivotable with respect to a frame by a boom cylinder and for leveling a material handling unit pivotable with respect to the boom by a unit cylinder during raising and lowering the boom, the boom cylinder having a boom-raise chamber and a boom-lower chamber, the unit cylinder having a tilt-up chamber and a tilt-down chamber, the control system comprising:

(a) a directional boom control valve having first and second boom control ports,. the boom direction-control valve being selectively movable from a neutral position to a boom-raise position passing fluid from a pressure source to the first boom control port and returning fluid from the second boom control port to a reservoir, and to a boom-lower position passing fluid from the pressure source to the second boom control port and returning fluid from the first boom control port to the reservoir, and to a float position communicating the first and second boom control ports with the reservoir;

(b) a directional unit control valve having first and second unit control ports, the unit control valve being selectively movable from a neutral position to a tilt-up position passing fluid from the pressure source to the first unit control port and to a tilt-down position passing fluid from the pressure source to the second unit control port, (c) a modulating valve including valve housing means having an elongated valve chamber, a first flow port communicating through a first flow passage with the first boom control port and a second flow port communicating through a second flow passage with the boom-raise chamber of the boom cylinder, a valve spool slidable in the valve chamber between open and closed positions, the valve spool having first and second end areas cooperating with the valve housing means to define first and second pilot chambers at opposite ends of the valve spool;

(d) a proportional flow divider/combiner valve having a primary passage and first and second secondary passages, the primary passage being connected by a third flow passage to the boom-lower chamber of the boom cylinder, the first secondary passage being connected by a fourth flow passage to the tilt-down chamber of the unit cylinder, and a fifth flow passage connecting the tilt-up chamber of the unit cylinder and the second secondary passage to the second boom control port, the flow divider/combiner valve being configured to divide a single inlet stream from the primary passage in a preset ratio into two separate outlet streams at the first and second secondary passages to control leveling of the unit when the boom control valve is moved to the boom-raise position, and reversely, to combine two separate inlet streams from the first and second secondary passages in said preset ratio into a single outlet stream at the primary passage, to control leveling of the unit when the boom control valve is moved to the boom-lower position, (e) means for pressing the valve spool of the modulating valve to the closed position comprising:

(i) a spring applying spring pressure biasing the valve spool to the closed position;

(ii) first pilot means applying pilot pressure to the first pilot chamber including a first pilot passage having a first pilot orifice communicating the second flow passage with the first pilot chamber, and a second pilot passage having a second pilot orifice communicating the first pilot chamber with the first flow passage, the second pilot passage having a check valve therein arranged to close and block flow therethrough from the first flow passage, (iii) the spring and the first and second pilot orifices being configured :so that the combined spring pressure and pilot pressure is less than the boom induced pressure in the second flow passage when the boom control valve is in the float position:

(f) means for actuating the valve spool of the modulating valve in the boom-raise, boom-lower and float positions of the boom control valve comprising:

(i) a third pilot passage having a third pilot orifice therein operative in the boom-raise position to apply pressure from the first flow passage to the second pilot chamber to move the valve spool away from the closed position;

(ii) means operative in the boom-lower position of the boom control valve for applying pilot pressure to the second pilot chamber, said last mentioned means including a fourth pilot passage having a fourth pilot orifice communicating the fifth flow passage with the second pilot chamber, the fourth pilot passage having a check valve therein arranged to block flow from the second pilot chamber to the fifth flow passage, the third and fourth pilot orifices being configured to apply pilot pressure to the second pilot chamber to move the valve spool out of the closed position when the pressure in the fifth flow passage rises to a level at which the unit cylinder initiates tilt-up movement of the unit under a preselected load -on the unit;

(iii) a pilot valve operative when opened in the float position of the boom-control valve for applying pilot pressure from the second flow passage to the second pilot chamber to move the valve spool away from the closed position.

12. A hydraulic control system according to claim 11 wherein the means operative in the boom-lower position for applying pilot pressure to the second pilot chamber includes a fifth pilot passage communicating the third flow passage with the second pilot chamber, the fifth pilot passage having a check valve therein arranged to block flow from the second pilot chamber to the third flow passage.

13. A Hydraulic control system according to claim 11 wherein said second pilot orifice and the third pilot orifice are provided on the valve spool.

14. A hydraulic control system according to claim 11 including leveling disengagement valve means movable between open and closed positions, and means for moving the leveling disengagement valve means between said open and closed positions, the leveling disengagement valve means being operative in the closed position:

(i) to block flow between the tilt-down chamber of the unit cylinder and the first secondary passage of the flow divider/combiner valve and;

(ii) to block flow between the tilt-up chamber of the unit cylinder and the second secondary passage of the flow divider/combiner valve and;

(iii) to communicate the first secondary passage with he second secondary passage of the flow divider/combiner valve, and passage means operative when the leveling disengagement valve means is in the closed position, to provide passage means for passing fluid between the first unit control port and the tilt-down chamber of the unit cylinder and for passing fluid between the second unit control port and the tilt-up chamber of the unit cylinder.

15. A hydraulic control system for raising and lowering a lift boom pivotable with respect to a frame by a boom cylinder and for leveling a material handling unit pivotable with respect to the boom by a unit cylinder during raising and lowering the boom, the boom cylinder having a boom-raise chamber at a base end of the boom cylinder and a boom-lower chamber at a rod end of the boom cylinder, the unit cylinder having a tilt-up chamber and a tilt-down chamber, the control system comprising:

(a) a four-position directional boom control valve having first and second boom control ports, the boom control valve being selectively movable from a neutral position to a boom-raise position passing fluid from a pressure source to the first boom control port and returning fluid from the second boom control port to a reservoir; and to a boom-lower position passing fluid from the pressure source to the second boom control port and returning fluid from the first boom control port to the reservoir, and to a float position communicating the first and second boom control ports with each other and with the reservoir, (b) a directional unit control valve having first and second unit control ports, the unit control valve being selectively movable from a neutral position to a tilt-up position passing fluid from the pressure source to the first unit control port and to a tilt-down position passing fluid from the pressure source to the second unit control port, (c) a modulating valve including valve housing means having an elongated valve chamber, a first flow port communicating through a first flow. passage with the first boom control port and a second flow port communicating through a second flow passage with the boom-raise chamber of the boom cylinder, a valve spool slidable in the valve chamber between open and closed positions, the valve spool having first and second end areas cooperating with the valve housing means to define first and second pilot chambers at opposite ends of the valve spool, (d) a proportional flow divider/combiner valve having a primary passage and first and secondary passages, the primary passage being connected by a third flow passage to the boom-lower chamber of the boom cylinder, the first secondary passage being connected by a fourth flow passage to the tilt-down chamber of the unit cylinder, and a fifth flow passage connecting to the tilt-up chamber of the unit cylinder to the second secondary passage and to the second boom control port, the flow divider/combiner valve being configured to divide a single inlet stream from the primary passage in a preset ratio into two separate outlet streams at the first and second secondary passages to control leveling of the unit when the boom control valve is moved to the boom-raise position, and reversely, to combine two separate inlet streams from the first and second secondary passages in said preset ratio into a single outlet stream at the primary passage, to control leveling of the unit when the boom control valve is moved to the boom-lower position.

(e) leveling disengagement valve means movable between open and closed positions, and means for moving the leveling disengagement valve means between the open and closed positions, the leveling disengagement valve means being operative in the closed position:

(i) to communicate the first secondary passage with the second secondary passage of the flow divider/combiner valve;

(ii) to block flow through the fourth flow passage between the tilt-down chamber of the unit cylinder and the first secondary passage of the flow divider/combiner valve; and (iii) to block flow through the fifth flow passage between the tilt-up chamber of the unit cylinder and the second secondary passage of the flow divider/combiner valve;

(f) passage means operative when the leveling disengagement valve means is in the closed position, for passing fluid between the first unit control port and the tilt-down chamber of the unit cylinder and for passing fluid between the second unit control port and the tilt-up chamber of the unit cylinder;

(g) means for pressing the modulating valve spool to the closed position comprising:

(i) a spring applying spring pressure urging the valve spool to the closed position;

(ii) first pilot means for applying pilot pressure to the first pilot chamber, the first pilot means including a first pilot passage having a first pilot orifice communicating the first flow passage with the first pilot chamber, and a second pilot passage having a second pilot orifice communicating the first pilot chamber with the second flow passage, the first pilot passage having a first pilot check valve therein arranged to block the flow therethrough from the first flow passage;

(iii) the spring and the first and second pilot orifices being configured so that the combined spring pressure and pilot pressure applied to the first pilot chamber is less than the boom induced pressure in the second flow passage when the modulating valve is in the float position;

(h) means for actuating the modulating valve spool of the modulating valve comprising:

(i) a third pilot passage having a third pilot orifice therein communicating the second pilot chamber with the first flow passage, (ii) pilot passage means operative in the boom-lower position to communicate the third flow passage with the second pilot chamber, the pilot passage means having a check valve therein arranged to block flow from the second pilot chamber to the third flow passage, the pilot passage means operative to apply the pilot pressure to the second pilot chamber sufficient to overcome the spring pressure and pilot pressure acting on the first end area of the valve spool when the pressure in the third flow passage rises to a predetermined level above the pressure in the first flow passage;

(iii) a pilot valve operative when the boom control valve is in the float position for applying fluid pressure from the second flow passage to the second pilot chamber to move the modulating valve spool away from the closed position.

16. A hydraulic control system according to claim 15 including a fourth pilot passage having a fourth pilot orifice therein operative in the boom-raise position of the boom control valve to communicate the fifth flow passage with the second pilot chamber, the fourth pilot passage having a check valve therein operative to block flow from the second pilot chamber to the fifth flow passage, the fourth pilot orifice in the fourth flow passage and said third pilot orifice in said third flow passage being configured to apply pilot pressure to the second pilot chamber to move the valve out of the closed position when the pressure in the fifth flow passage rises to a level at which the unit cylinder initiates tilt-up movement of the unit under a preselected load.

17. A hydraulic control system for raising and lowering a lift boom pivotable with respect to a frame by a boom cylinder and for leveling a material handling unit pivotable with respect to the boom by a unit cylinder during raising and lowering the boom, the boom cylinder having a boom-raise chamber at a base end of the boom cylinder and a boom-lower chamber at a rod end of the boom cylinder, the unit cylinder having a tilt-up chamber and a tilt-down chamber, the control system comprising:

(a) a four-position directional boom control valve having first and second boom control ports, the boom control valve being selectively movable from a neutral position to a boom-raise position passing fluid from a pressure source to the first boom control port and returning fluid from the second boom control port to a reservoir; and to a boom-lower position passing fluid from the pressure source to the second boom control port and returning fluid from the first boom control port to the reservoir, and to a float position communicating the first and second boom control ports with each other and with the reservoir, (b) a directional unit control valve having first and second unit control ports,:the unit control valve being selectively movable from a neutral position to a tilt-up position passing fluid from the pressure source to the first unit control port and to a tilt-down position passing fluid from the pressure source to the second unit control port, (c) a modulating valve including valve housing means having an elongated valve chamber, a first flow port communicating through a first flow passage with the first boom control port and a second flow port communicating through a second flow passage with the boom-raise chamber of the boom cylinder, a valve spool slidable in the valve chamber between open and closed positions, the valve spool having first and second end areas cooperating with the valve housing means to define first and second pilot chambers at opposite ends of the valve spool, (d) a proportional flow divider/combiner valve having a primary passage and first and secondary passages, the primary passage being connected by a third flow passage to the boom-lower chamber of the boom cylinder, the first secondary passage being connected by a fourth flow passage to the tilt-down chamber of the unit cylinder, and a fifth flow passage connecting to the tilt-up chamber of the unit cylinder to the second secondary passage and to the second boom control port, the flow divider/combiner Valve being configured to divide a single inlet stream from the primary passage in a preset ratio into two separate outlet streams at the first and second secondary passages to control leveling of the unit when the boom control valve is moved to the boom raise position, and reversely, to combine two separate inlet streams form the first and second secondary passages in said preset ratio into a single outlet stream at the primary passage, to control leveling of the unit when the boom control valve is moved to the boom-lower position, (e) means for pressing the modulating valve spool to the closed position comprising:

(i) a spring applying spring pressure urging the valve spool to the closed position;

(ii) first pilot means for applying pilot pressure to the first pilot chamber, the first pilot means including a first pilot passage having a first pilot orifice communicating the first flow passage with the first pilot chamber, and a second pilot passage having a second pilot orifice communicating the first pilot chamber with the second flow passage, the first pilot passage having a first pilot check valve therein arranged to block the flow therethrough from the first flow passage;

(iii) the spring and the first and second pilot orifices being configured so that the combined spring pressure and pilot pressure applied to the first pilot chamber is less than the boom induced pressure in the second flow passage when the modulating valve is in the float position;

(f) means for actuating the modulating valve spool of the modulating valve comprising:

(i) a third pilot passage having a third pilot orifice therein communicating the second pilot chamber with the first flow passage, (ii) a fourth pilot passage having a fourth pilot orifice therein operative in the boom-lower position of the boom control valve to communicate the fifth flow passage with the second pilot chamber, the fourth pilot passage having a check valve therein operative to block flow from the second pilot chamber to the fifth flow passage, the fourth pilot orifice in the fourth flow passage and said third pilot orifice in said third flow passage configured to apply pilot pressure to the second pilot chamber to move the valve spool out of the closed position when the pressure in the fifth flow passage rises to a level at which the unit cylinder-initiates tilt-up movement of the unit under a preselected load, (iii) a fifth pilot passage operative in the boom-lower position to communicate the third flow passage with the second pilot chamber, the fifth pilot passage having check valve therein arranged to block flow from the second pilot chamber to the third low passage, the fifth pilot passage being operative to apply the pressure to the second pilot chamber sufficient to overcome the spring pressure and pilot pressure acting on the first end area of the valve spool when the pressure in the third flow passage rised to a predetermined level above the level in the first flow passage; and (iv) a pilot valve operative when the boom control valve is in the float position for applying fluid pressure from the second flow passage to the second pilot chamber to move the modulating valve spool away from the closed position.

* * * * *